US011014358B2

(12) United States Patent
Hamano et al.

(10) Patent No.: US 11,014,358 B2
(45) Date of Patent: May 25, 2021

(54) INK JET HEAD AND INK JET RECORDING APPARATUS

(71) Applicant: KONICA MINOLTA, INC., Tokyo (JP)

(72) Inventors: Hikaru Hamano, Saitama Saitama (JP); Souichi Tanaka, Machida Tokyo (JP); Tomohiro Nishiura, Hachioji Tokyo (JP); Jun Marubayashi, Kodaira Tokyo (JP); Yusuke Hayashi, Hino Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/090,381

(22) PCT Filed: Mar. 13, 2017

(86) PCT No.: PCT/JP2017/009881
§ 371 (c)(1),
(2) Date: Oct. 1, 2018

(87) PCT Pub. No.: WO2017/169681
PCT Pub. Date: Oct. 5, 2017

(65) Prior Publication Data

US 2019/0111679 A1 Apr. 18, 2019

(30) Foreign Application Priority Data

Mar. 31, 2016 (JP) ..... JP2016-072257

(51) Int. Cl.
*B41J 2/14* (2006.01)
*B41J 2/16* (2006.01)
*B41J 2/18* (2006.01)

(52) U.S. Cl.
CPC ..... *B41J 2/1433* (2013.01); *B41J 2/14* (2013.01); *B41J 2/14209* (2013.01);
(Continued)

(58) Field of Classification Search
CPC . B41J 2/143; B41J 2/14; B41J 2/14209; B41J 2/1609; B41J 2/1623; B41J 2/18
See application file for complete search history.

(56) References Cited

U.S. PATENT DOCUMENTS

2008/0316278 A1 12/2008 Van Den Bergen
2015/0109374 A1* 4/2015 Horiguchi ..... B41J 2/1623 347/71

FOREIGN PATENT DOCUMENTS

CN 104553326 A 4/2015
EP 1741556 A1 1/2007
(Continued)

OTHER PUBLICATIONS

International Search Report corresponding to Application No. PCT/JP2017/009881; dated Apr. 25, 2017.
(Continued)

*Primary Examiner* — Jason S Uhlenhake
(74) *Attorney, Agent, or Firm* — Cantor Colburn LLP

(57) ABSTRACT

An ink jet head with a head chip including a nozzle layer with nozzles for jetting ink and a pressure chamber layer with pressure chambers communicated respectively with the nozzles; and a manifold which stores the ink to be supplied to the pressure chambers; where the head chip has individual communication flow paths which are communicated respectively with the pressure chambers and which are capable of discharging the ink in the pressure chambers; and a common communication flow path which is disposed in a part facing the nozzle layer of the pressure chamber layer and which is connected to the individual communication flow paths to
(Continued)

join the ink discharged from the individual communication flow paths together.

9 Claims, 15 Drawing Sheets

(52) U.S. Cl.
CPC ..... *B41J 2/1609* (2013.01); *B41J 2/1623* (2013.01); *B41J 2/18* (2013.01)

(56) References Cited

FOREIGN PATENT DOCUMENTS

| | | | | |
|---|---|---|---|---|
| JP | 2002264329 | a2 | * | 8/2001 |
| JP | 2002264329 | A | | 9/2002 |
| JP | 2012011678 | A | | 1/2012 |
| JP | 5047958 | B2 | | 10/2012 |
| JP | 2013147019 | A | | 8/2013 |
| JP | 5381915 | B2 | * | 1/2014 |
| JP | 5381915 | B2 | | 1/2014 |
| JP | 201577736 | A | | 4/2015 |
| JP | 2015077736 | A | | 4/2015 |
| WO | 2007007074 | A1 | | 1/2007 |
| WO | WO2007006618 | a2 | * | 1/2007 |

OTHER PUBLICATIONS

Extended European Search Report corresponding to Application No. 17774225.1-1019/3437868 PCT/JP2017009881; dated Feb. 25, 2019.
PCT International Preliminary Report on Patentability and Written Opinion of the International Searching Authority corresponding to Application No. PCT/JP2017/009881; dated Oct. 2, 2018.
Chinese First Office Action corresponding to Application No. 201780020123.3; dated Aug. 6, 2019.
Office Action corresponding to EP Application No. 17774225.1 dated Jan. 30, 2020.
CNIPA Second Office Action corresponding to CN201780020123.3; dated Mar. 5, 2020.
CNIPA Third Office Action for corresponding CN Patent Application No. 201780020123.3; dated Jul. 10, 2020.
JPO Notice of Reasons for Refusal for corresponding JP Patent Application No. 2018-508940; dated May 19, 2020.
JPO Notice of Reasons for Refusal for corresponding JP Application No. 2018-508940, dated Nov. 24, 2020.

* cited by examiner

INK JET HEAD AND INK JET RECORDING APPARATUS

CROSS REFERENCE TO RELATED APPLICATIONS

This is the U.S. national stage of application for International Application No. PCT/JP2017/009881, filed on Mar. 13, 2017. Priority under 35 U.S.C. § 119(a) and 35 U.S.C. § 365(b) is claimed from Japanese Application No. 2016-072257, filed on Mar. 31, 2016, the disclosures all of which are also incorporated herein by reference.

TECHNICAL FIELD

The present invention relates to an ink jet head and an ink jet recording apparatus.

BACKGROUND ART

Ink jet recording apparatuses have been known in the art which form an image on a recording medium by jetting ink droplets from nozzles of an ink jet head. In ink jet recording apparatuses, single-pass printing of conveying a recording medium through a fixed ink jet head is known to have particularly high productivity. However, when there are bubbles and foreign matters near nozzles, a maintenance work is required to remove such bubbles and foreign matters. When the maintenance work takes a long time, the productivity is greatly deteriorated.

To address the problem, some ink jet recording apparatuses known in the art have a flow path in a head chip of an ink jet head, which can circulate ink to remove bubbles and the like near the nozzles without any additional maintenance work.

For example, Patent Document 1 discloses an ink jet head that includes a pressure chamber for storing ink to be jetted from nozzles and a communication flow path (high impedance channel) connected to the vicinity of the nozzles. In the ink jet head, the ink flows toward the nozzles through the communication flow path so that bubbles and the like near the nozzles can be discharged to a manifold through the pressure chamber.

Patent Document 2 discloses an ink jet head that includes pressure chambers that stores ink to be jetted through nozzles and that is defined by a partition wall of a piezoelectric material, individual communication flow paths connected to the vicinities of the nozzles, a common communication flow path that joins ink from the individual communication flow paths together, and a flow path for discharging the ink out of a head. In the ink jet head, the individual communication flow paths and a common communication flow path are disposed on a base board on which the nozzles are mounted, and bubbles and the like near the nozzles can be discharged out of the ink jet head through the flow paths along with the ink.

The ink jet heads of Patent Document 1 and Patent Document 2 can remove bubbles and the like near the nozzles while jetting ink from the nozzles. This can prevent deterioration of the productivity caused by an additional maintenance work.

PRIOR ART DOCUMENT

Patent Documents

Patent Document 1: JP 5047958B
Patent Document 2: JP 5381915B

SUMMARY OF INVENTION

Problem to be Solved by Invention

However, the ink jet head of Patent Document 1 requires providing the communication flow path (high impedance channel) and the pressure chamber having relatively large volume in a head chip. Accordingly, a problem is the increased size when the ink jet head includes a number of nozzles. Particularly in an ink jet recording apparatus (see FIG. 1) that performs continuous printing on recording media with a rotating drum and a fixed ink jet head, it is difficult to keep a constant distance between a recording medium and nozzles of the ink jet head and to perform high definition printing when the size of the ink jet head is large. Therefore, there is a need for reducing the size of the ink jet head. It is desirable to reduce the size of the ink jet head also in terms of the increased production cost due to increased materials for production and a reduction in size of the apparatus.

The ink jet head of Patent Document 2 can be reduced in size since the flow paths are disposed on the base board of the nozzles. However, since the individual communication flow paths and the common communication flow path are formed only in a narrow area in the base board of the nozzles, it is difficult to reduce the flow resistance of the flow paths. Therefore, it is therefore difficult to generate circulation flow of ink that is sufficient to discharge bubbles and the like.

The present invention has been made in view of these problems, and an object thereof is to provide an ink jet head and an ink jet recording apparatus that can be reduced in size and that have a flow path capable of effectively discharging bubbles and the like.

Means for Solving Problems

In order to solve the above problem, the invention according to claim 1 is an ink jet head, including:

a head chip which comprises a nozzle layer with nozzles for jetting ink and a pressure chamber layer with pressure chambers communicated respectively with the nozzles; and a manifold which stores the ink to be supplied to the pressure chambers;

wherein the head chip includes:

individual communication flow paths which are communicated respectively with the pressure chambers and which are capable of discharging the ink in the pressure chambers; and a common communication flow path which is disposed in a part facing the nozzle layer of the pressure chamber layer and which is connected to the individual communication flow paths to join the ink discharged from the individual communication flow paths together.

The invention according to claim 2 is the ink jet head according to claim 1, wherein a width in an ink jetting direction of the common communication flow path is greater than a thickness of the nozzle layer.

The invention according to claim 3 is the ink jet head according to claim 1 or 2, wherein the individual communication flow paths are disposed in a part facing the pressure chamber layer of the nozzle layer.

The invention according to claim 4 is the ink jet head according to any one of claims 1 to 3, wherein the pressure chamber layer comprises a discharge flow path which is communicated with the common communication flow path and which is capable of discharging the ink toward an opposite side from the nozzle layer.

The invention according to claim 5 is the ink jet head according to any one of claims 1 to 4, wherein a sealing member is provided in the common communication flow path at an end in a longitudinal direction of the head chip.

The invention according to claim 6 is the ink jet head according to any one of claims 1 to 4, wherein a width in an ink jetting direction of the common communication flow path decreases toward an end in the longitudinal direction of the head chip so that an upper face and a lower face come together to seal the common communication flow path.

The invention according to claim 7 is the ink jet head according to any one of claims 1 to 6, wherein the manifold is disposed above the pressure chambers.

The invention according to claim 8 is the ink jet head according to any one of claims 1 to 7, wherein the pressure chambers are partitioned from each other by a partition wall that causes share-mode displacement when a voltage is applied.

The invention according to claim 9 is an ink jet recording apparatus, including:

the ink jet head according to any one of claims 1 to 8;

an ink circulator for generating a circulation flow from the pressure chambers to the individual communication flow paths.

Advantageous Effects of Invention

With the present invention, it is possible to provide an ink jet head and an ink jet recording apparatus that can be reduced in size and that has a flow path capable of effectively discharging bubbles and the like.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

EMBODIMENTS FOR CARRYING OUT INVENTION

Figure 1:
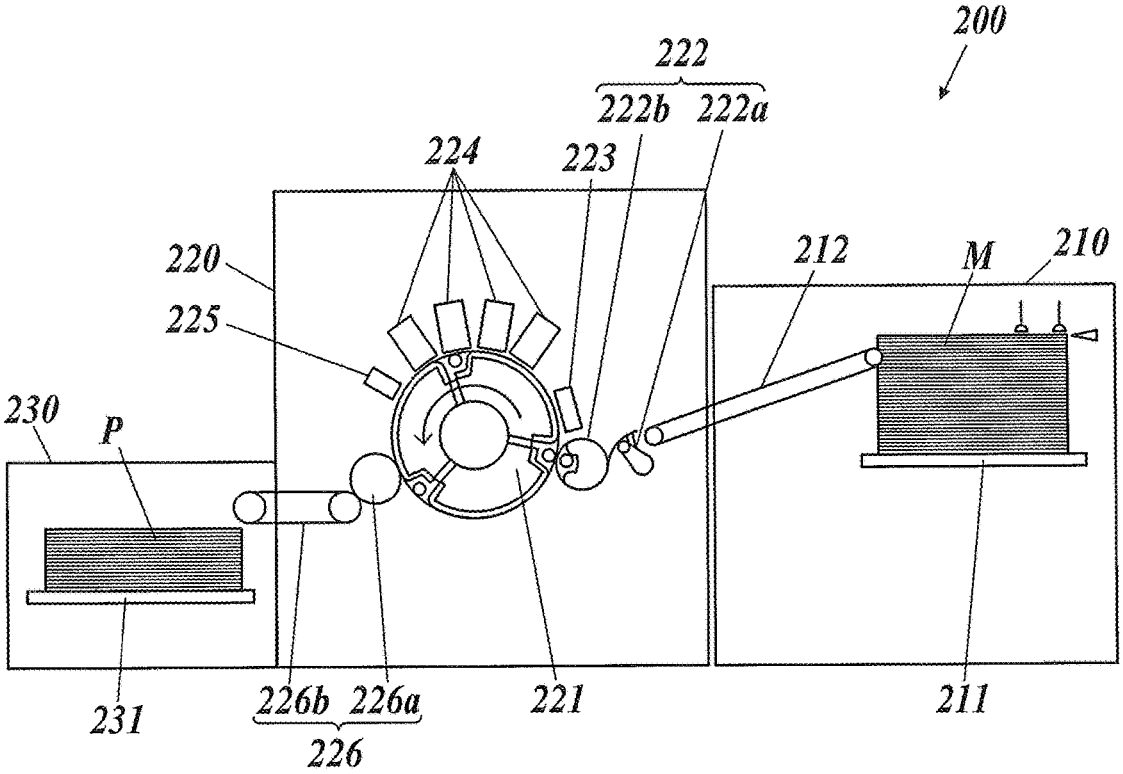
FIG. 1 is a schematic view of an ink jet recording apparatus.

Hereinafter, one or more embodiments of the present invention will be described with reference to the drawings. However, the scope of the invention is not limited to the disclosed embodiments.

Hereinafter, a preferred embodiment of the present invention will be described referring to the drawings. However, the scope of the invention is not limited to the illustrated examples. As used herein, the array direction of nozzles 11*a* of an ink jet head 100 is referred to as the right-left direction (see FIG. 2, FIG. 6 and FIG. 7), the ink jetting direction is referred to as the up-down direction, and the direction perpendicular to both right-left direction and up-down direction is referred to as the front-rear direction. Further, the arrows in the flow paths in the drawings represent the flow direction of ink.

Although embodiments of the present invention have been described and illustrated in detail, the disclosed embodiments are made for purposes of illustration and example only and not limitation. The scope of the present invention should be interpreted by terms of the appended claims.

Ink Jet Recording Apparatus

As illustrated in FIG. 1, an ink jet recording apparatus 200 includes a sheet feeder 210, an image recorder 220, a sheet ejector 230 and an ink circulating mechanism 8 (see FIG. 18) and the like. The ink jet recording apparatus 200 conveys a recording medium M stored in the sheet feeder 210 to the image recorder 220, forms an image on the recording medium M with the image recorder 220 and conveys the recording medium M with the image formed thereon to the sheet ejector 230.

Recording media M that can be used include a variety of media which can fix ink landed on the surface, such as fabric and sheet resin as well as paper such as normal paper and coated paper.

The sheet feeder 210 includes a sheet feeding tray 211 for storing the recording medium M and a medium feeder 212 that conveys and feeds the recording medium M from the sheet feeding tray 211 to the image recorder 220. The medium feeder 212, which includes a ring belt supported from inside by two rollers, conveys the recording medium M from the sheet feeding tray 211 to the image recorder 220 by rotating the rollers when the recording medium M is mounted on the belt.

The image recorder 220 includes a conveyance drum 221, a handover unit 222, a heater 223, head units 224, a fixer 225, a deliverer 226 and the like.

The conveyance drum 221 has a cylindrical surface, and the outer peripheral surface serves as a conveyance surface on which the recording medium M is mounted. The conveyance drum 221 conveys the recording medium M along the conveyance surface by rotating in the arrow direction in FIG. 1 when the recording medium M is held on the conveyance surface. The conveyance drum 221 includes hooks and suctioning parts (not shown). The hooks fix an end of the recording medium M, and the suctioning parts suction the recording medium M on the conveyance surface, so that the recording medium M is held on the conveyance surface.

The handover unit 222, which is disposed between the medium feeder 212 of the sheet feeder 210 and the conveyance drum 221, catches and picks up an end of the recording medium M conveyed from the medium feeder 212 with a swing arm 222*a* and hands it over to the conveyance drum 221 via the handover drum 222*b*.

The heater 223, which is disposed between the position of the handover drum 222*b* and the position of the head units 224, heats the recording medium M conveyed from the conveyance drum 221 so that the temperature of the recording medium M falls within a predetermined temperature range. The heater 223, which includes, for example, an infrared heater and the like, applies electricity to the infrared heater according to a control signal supplied from the hardware processor (not shown) to generate heat.

The head units 224 jet ink to the recording medium M based on image data at a suitable timing in synchronization with the rotation of the conveyance drum 221 on which the recording medium M is held, so as to form an image. The head units 224 is disposed such that ink jetting surfaces are opposed to the conveyance drum 221 at a predetermined distance. In the ink jet recording apparatus 200 of the embodiment, for example, four head units 224 corresponding respectively to the four colors of yellow (Y), magenta (M), cyan (C) and black (K) are aligned at predetermined intervals in the order of Y, M, C and K from the upstream of the conveyance direction of the recording medium M.

Figure 2:
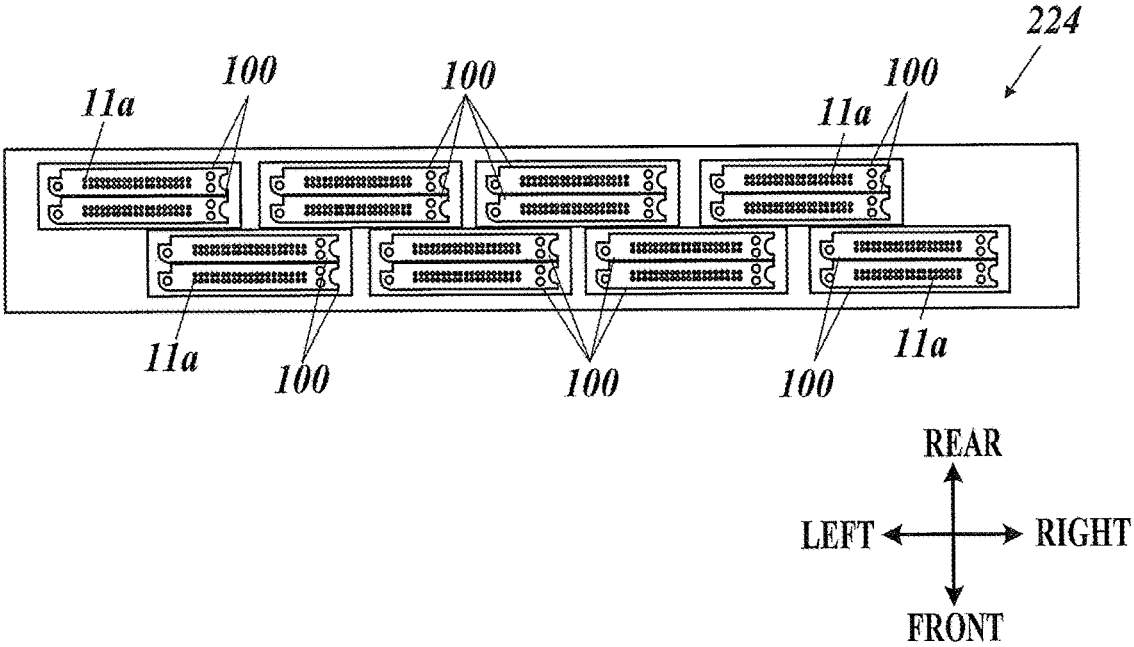
FIG. 2 is a bottom view of a head unit.

In the head units 224, pairs of ink jet heads 100, each mutually adjacent in the front-rear direction, are arranged in a staggered pattern that staggers in the front-rear direction as illustrated in the bottom view in FIG. 2. In this arrangement of the ink jet heads 100, the array width in the right-left direction of the nozzles 11*a* of the ink jet heads 100 is equal to or greater than the width of an image forming area of the recording medium M. The head units 224 are fixed relative to the rotation axis of the conveyance drum 221 when an image is being recorded. That is, the ink jet recording apparatus 200 records an image by single-pass printing with the line heads.

For example, the ink to be jetted from the nozzles 11*a* of the ink jet heads 100 has the characteristics of causing phase transition between gel and sol depending on temperature and curing by energy ray such as ultraviolet ray.

For example, the ink that is used in the embodiment is in gel state at ordinary temperature but turns into solution when heated. The head units 224 include ink heaters (not shown) for heating the ink stored in the head units 224. The ink heaters can heat the ink to a temperature at which the ink is in solution state. The ink jet heads 100 jet the heated solution ink. When the solution ink is jetted to the recording medium M, ink droplets that are landed on the recording medium M are naturally cooled to rapidly turn into gel. The ink is thus solidified on the recording medium M.

The fixer 225, which includes a light emitter disposed over the conveyance drum 221 in the X direction, emits an energy ray such as ultraviolet ray from the light emitter to the recording medium M mounted on the conveyance drum 221 so as to cure and fix the ink jetted on the recording medium M. The light emitter of the fixer 225 is disposed opposite to the conveyance surface in the downstream of the position of the head units 224 and the upstream of the position of a handover drum 226*a* of the deliverer 226 with respect to the conveyance direction.

The deliverer 226 includes a belt loop 226*b* with a ring belt supported from inside by two rollers, and the cylindrical handover drum 226*a* that hands over the recording medium M from the conveyance drum 221 to the belt loop 226*b*. The belt loop 226*b* conveys the recording medium M toward the sheet ejector 230, which has been handed over from the conveyance drum 221 onto the belt loop 226*b* by the handover drum 226*a*.

The sheet ejector 230 includes a sheet ejecting tray 231 having a plate shape on which the recording medium P sent from the image recorder 220 by the deliverer 226 is placed.

Ink Jet Head

Figure 3A:
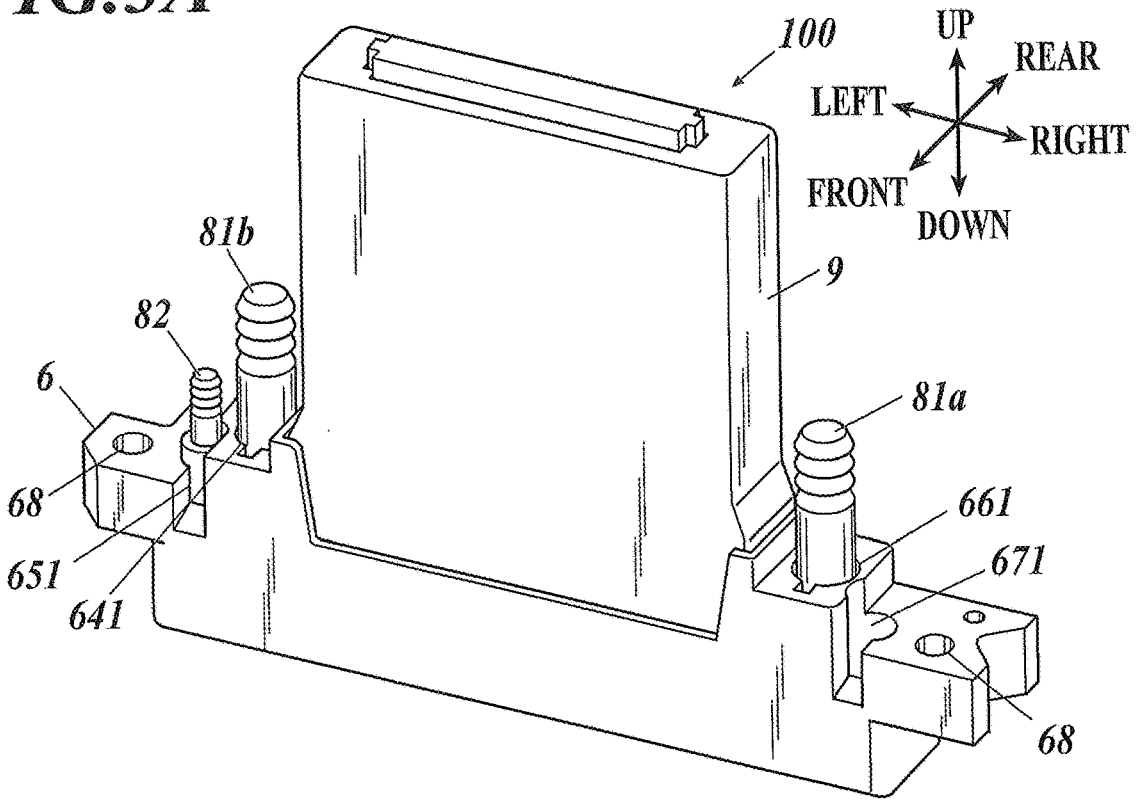
FIG. 3A is a perspective view of an ink jet head.
Figure 3B:
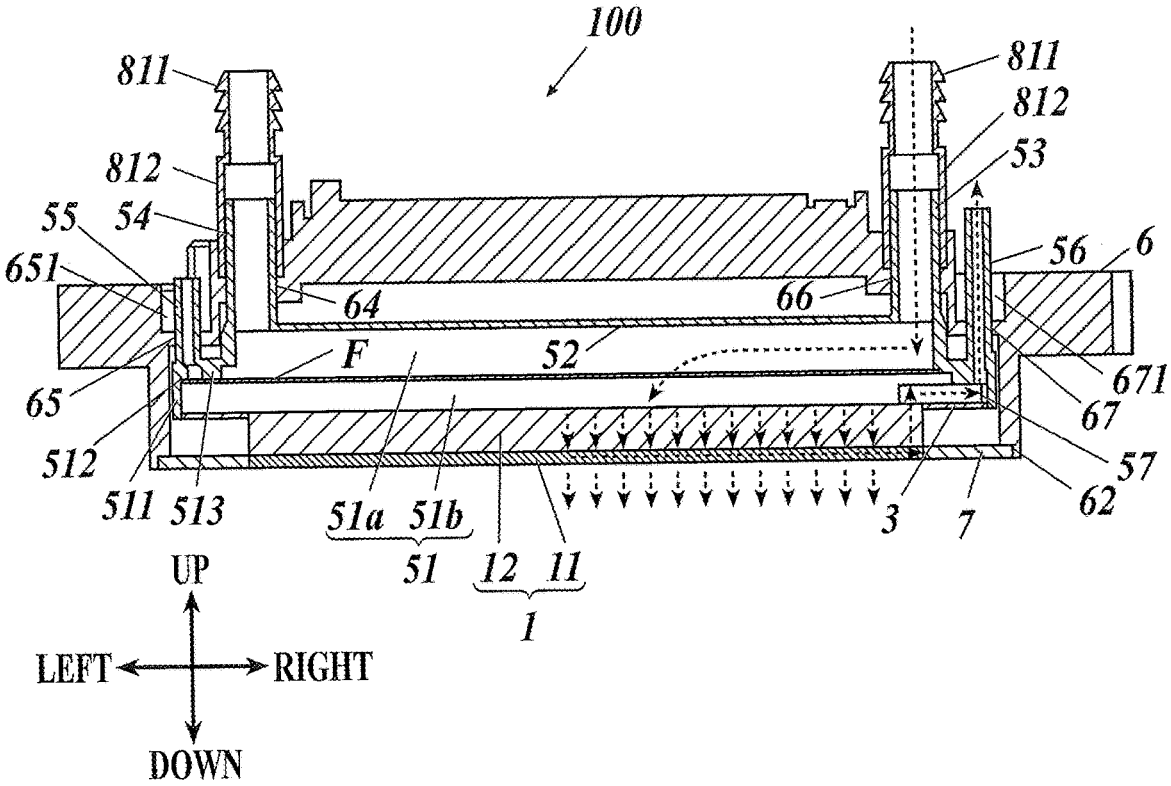
FIG. 3B is a cross-sectional view of the ink jet head.
Figure 4:
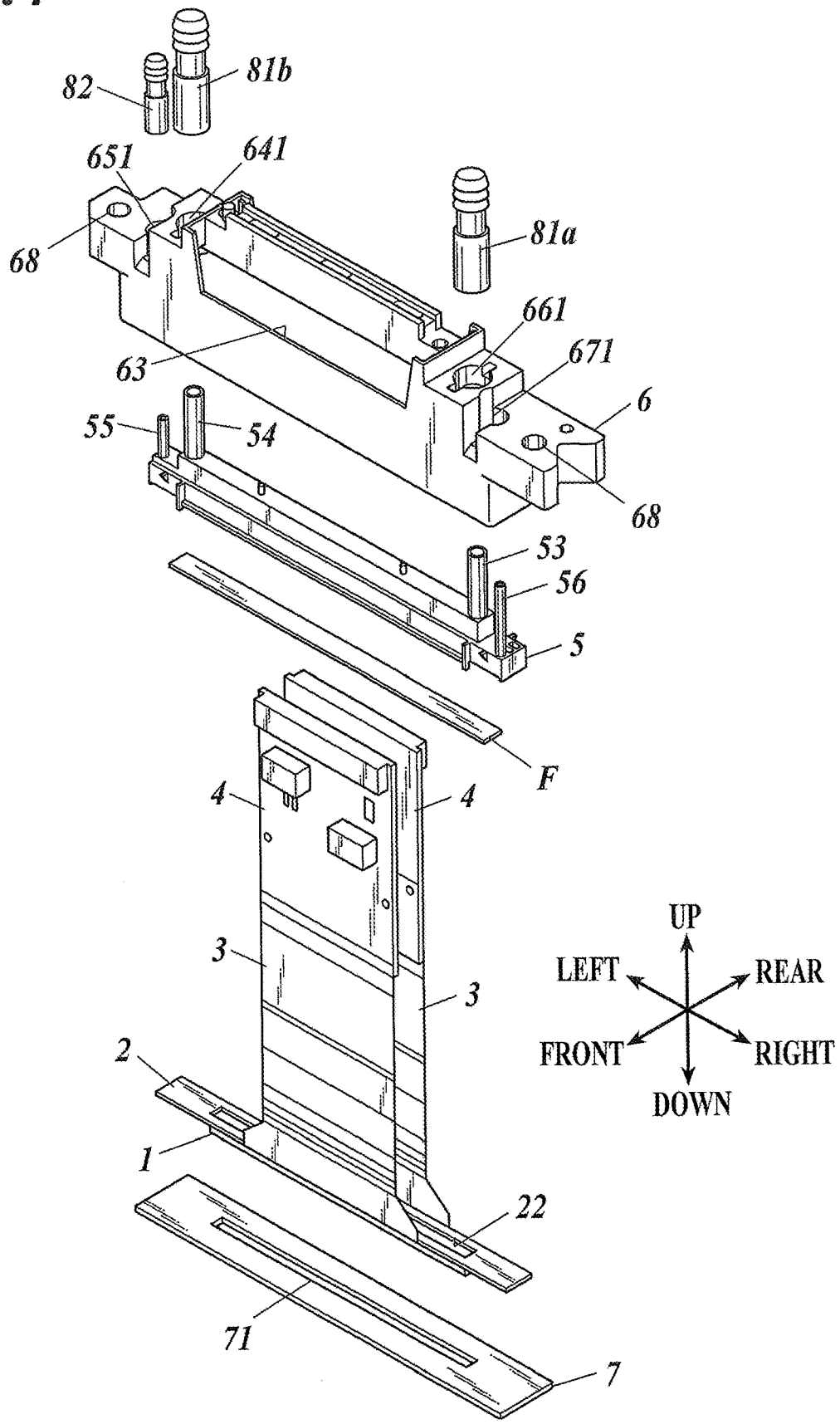
FIG. 4 is an exploded perspective view of the ink jet head.

FIG. 3A is a perspective view of an ink jet head 100 of the embodiment in which the present invention is implemented, and FIG. 3B is a cross-sectional view of the ink jet head 100. FIG. 4 is an exploded perspective view of the ink jet head 100. A manifold 5 is not shown in FIG. 3A, and a cover member 9 is not shown in FIG. 3B and FIG. 4.

This embodiment is an example in which the head chip 1 has two nozzle lines. However, the number of lines and the arrangement of the nozzles 11*a* can be suitably changed. For example, the head chip 1 may also have a single line, or three or more lines.

As illustrated in FIG. 3A, FIG. 3B and FIG. 4, each of the ink jet heads 100 of the embodiment includes the head chip 1, a wiring board 2 on which the head chip 1 is disposed, driver circuit boards 4 connected via the wiring board 2 and flexible boards 3, the manifold 5 that stores the ink to be supplied to pressure chambers 13A in the head chip 1, a case 6 in which the manifold 5 is housed, a cap receiver plate 7 that is attached to close a bottom opening of the case 6, the cover member 9 that is attached to the case 6, and the like.

The head chip 1 has an approximately square pillar shape that is long in the right-left direction. The head chip 1 is composed of a nozzle layer 11 and a pressure chamber layer 12 (see FIG. 6 and FIG. 7). FIG. 7 to FIG. 13 schematically illustrate an enlargement of a part of the head chip 1, but the portion at the left end of the head chip 1 is not shown in the figures.

The pressure chamber layer 12 includes the pressure chambers 13A, discharge flow paths 13B and common communication flow paths 19.

The pressure chambers 13A, which are separated from each other by partition walls of a piezoelectric material, store the ink to be jetted from the nozzles 11*a*. In an inner wall of each of the pressure chambers 13A, a driver electrode 14 is provided to move a partition wall between adjacent pressure chambers 13A. When a voltage is applied to the driver electrode 14, the partition wall between the adjacent pressure chambers 13A repeats share-mode displacement to apply a pressure on the ink in the pressure chamber 13A. In the embodiment, the driver electrode 14 is constituted by a metal film.

Each of the pressure chambers 13A, which has an approximately rectangular cross section, extends in the up-down direction and has an inlet in the top surface of the pressure chamber layer 12 and an out let in the bottom surface. Each of the pressure chambers 13A is a straight-type chamber that has approximately uniform size and the shape in the longitudinal direction (up-down direction) from the inlet to the outlet. The pressure chambers 13A are disposed parallel to each other. The pressure chambers 13A are arrayed in the right-left direction such that they form two lines adjacent in the front-rear direction. In the figures other than FIG. 6, the driver electrodes 14 are not shown.

The discharge flow paths 13B, which are defined by partition walls as with the pressure chambers 13A, are provided to discharge the ink upward (to the opposite side from the nozzle layer 11) out of the ink jet heads 100. The discharge flow paths 13B extends in the up-down direction and has outlets in the top surface of the pressure chamber layer 12 and inlets in the bottom surface. The discharge flow paths 13B are straight-type paths that have approximately the same size and the shape in the longitudinal direction (up-down direction) from the inlets to the outlets. Two discharge flow paths 13B are disposed near the right end of the head chip 1 parallel to the pressure chambers 13A.

Figure 6:
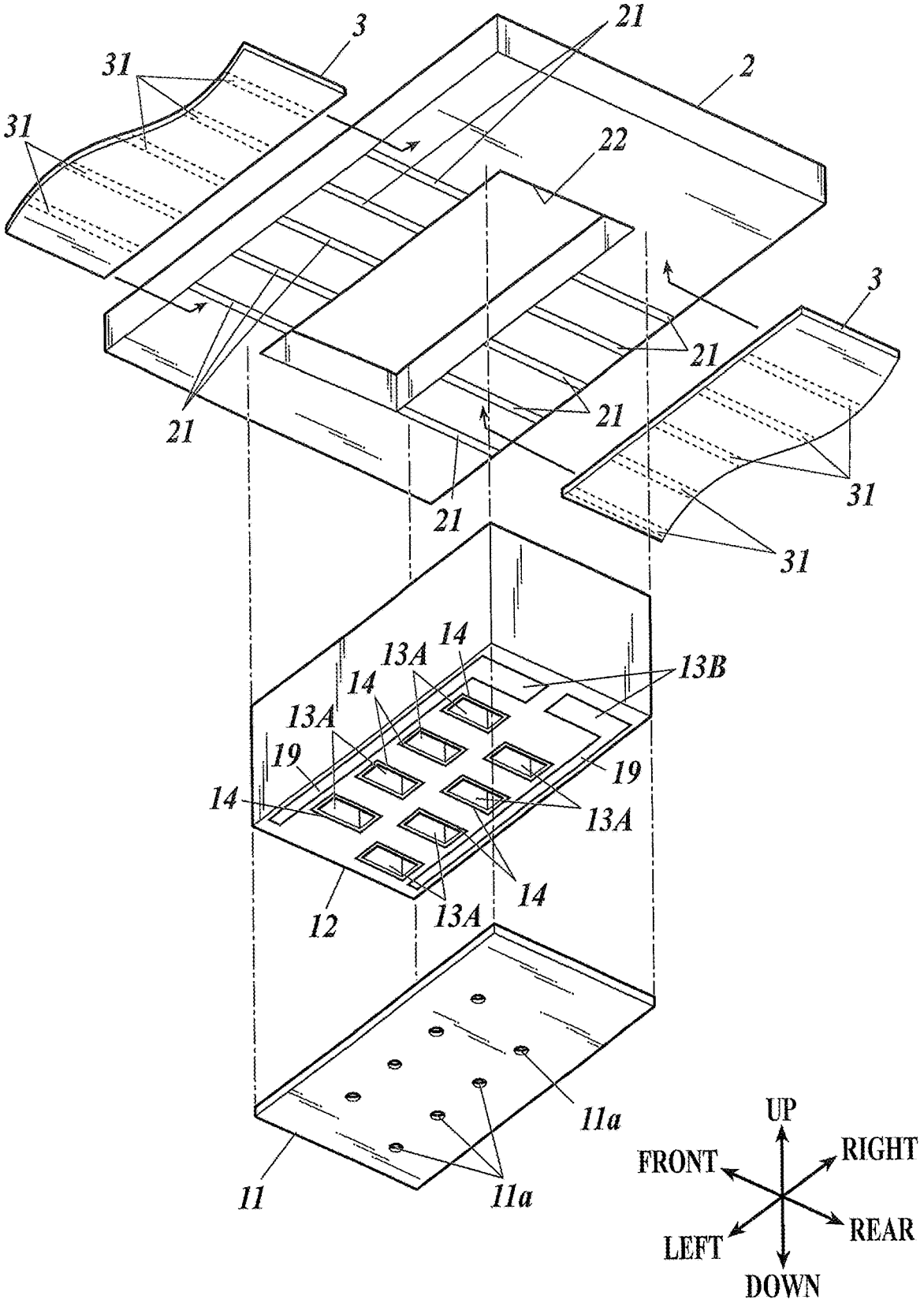
FIG. 6 is a schematic exploded perspective view of the head chip and the wiring board.
Figure 10:
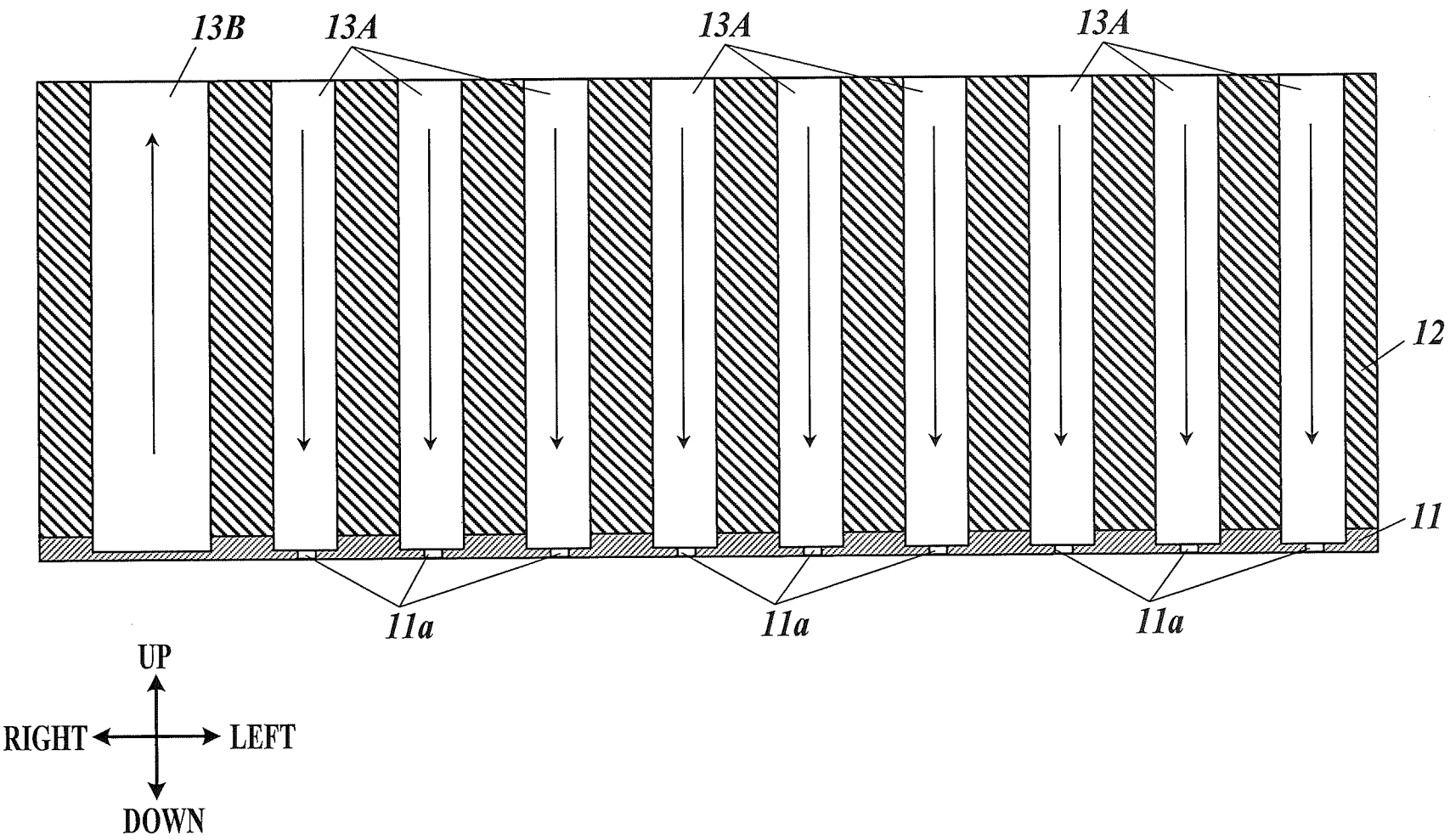
FIG. 10 is a cross-sectional view taken along the line X-X in FIG. 7.
Figure 11:
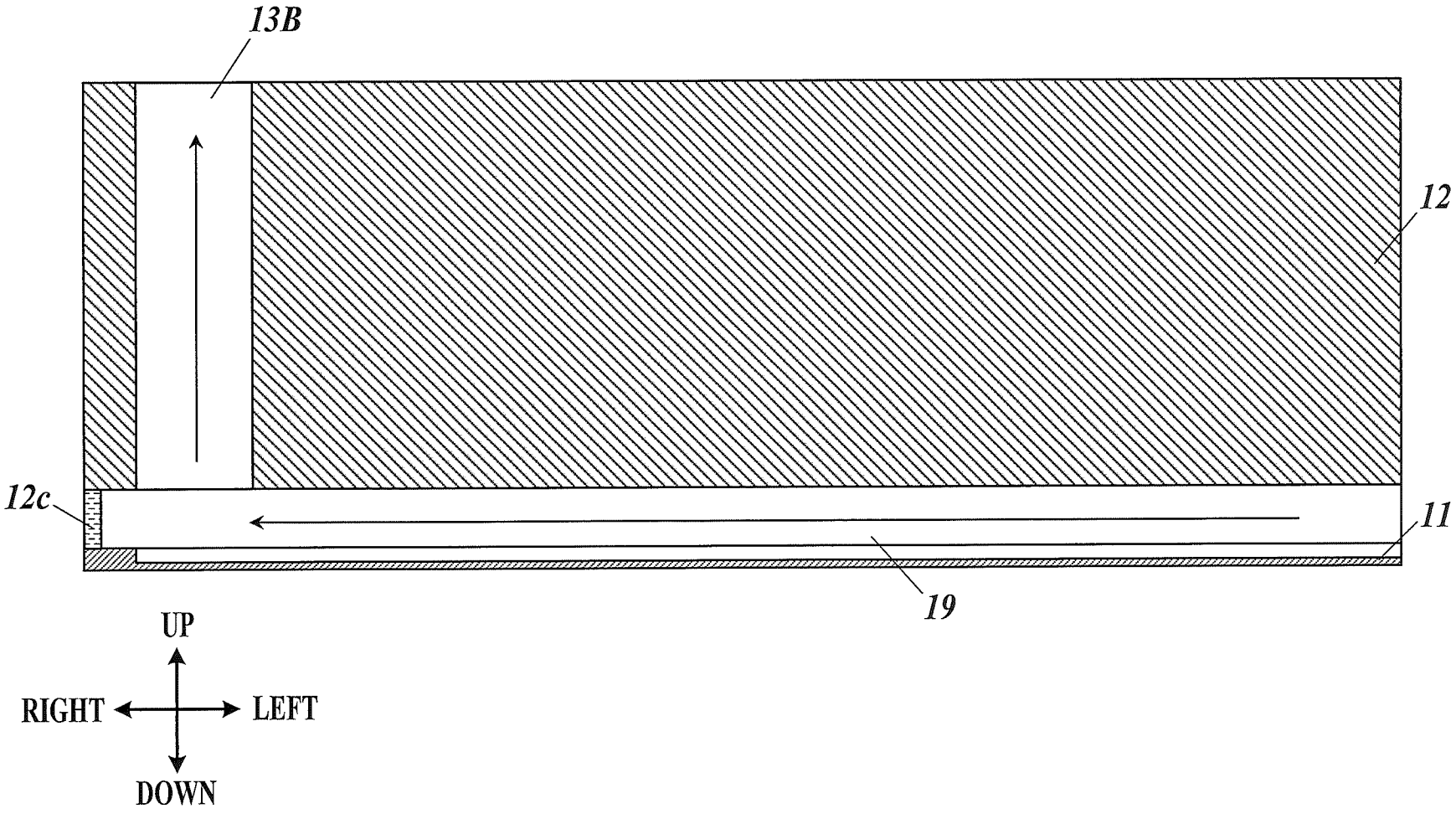
FIG. 11 is a cross-sectional view taken along the line XI-XI in FIG. 7.

It is preferred that the discharge flow paths 13B have a volume that is greater than the volume of the pressure chambers 13A as illustrated in FIG. 6, FIG. 10 and FIG. 11 in order to improve the efficiency of discharging the ink.

The common communication flow paths 19 are disposed in the part facing the nozzle layer 11 of the pressure chamber layer 12. The common communication flow paths 19 are connected to individual communication flow paths 18 which are further connected to the pressure chambers 13A, so that the ink flowing through the individual communication flow paths 18 joins together. The common communication flow paths 19 are disposed in the right-left direction for the respective nozzle lines, which are communicated with the discharge flow paths 13B near the right ends of the common flow paths (see FIG. 6, FIG. 7 and FIG. 11). In the embodiment, since the common communication flow paths 19 are disposed in the pressure chamber layer 12, the width in the up-down direction of the common communication flow paths 19 can be greater than the thickness of the nozzle layer 11. This allows increasing the volume of the flow paths compared to a case in which the common communication flow paths are disposed only in the nozzle layer 11. Further, the common communication flow paths 19 with a large volume can increase the amount of ink circulated in the head chip 1. This allows efficient discharge of bubbles and the like. Further, this allows efficient heat dissipation from the head chip 1.

The nozzle layer 11 is constituted by a rectangular plate member, which is disposed on the bottom surface of the pressure chamber layer 12 to close lower ends of the pressure chambers 13A and the discharge flow paths 13B. The nozzle layer 11 includes the nozzles 11*a* and the individual communication flow paths 18 and the like.

The nozzles 11*a*, which are disposed opposite to the respective pressure chambers 13A, penetrate the nozzle layer 11 in the thickness direction (up-down direction) so as to jet the ink stored in the communicated pressure chambers 13A. In the embodiment, the nozzles 11*a* are arrayed in the right-left direction. Further, the nozzles 11*a* form two lines adjacent in the front-rear direction.

Figure 8:
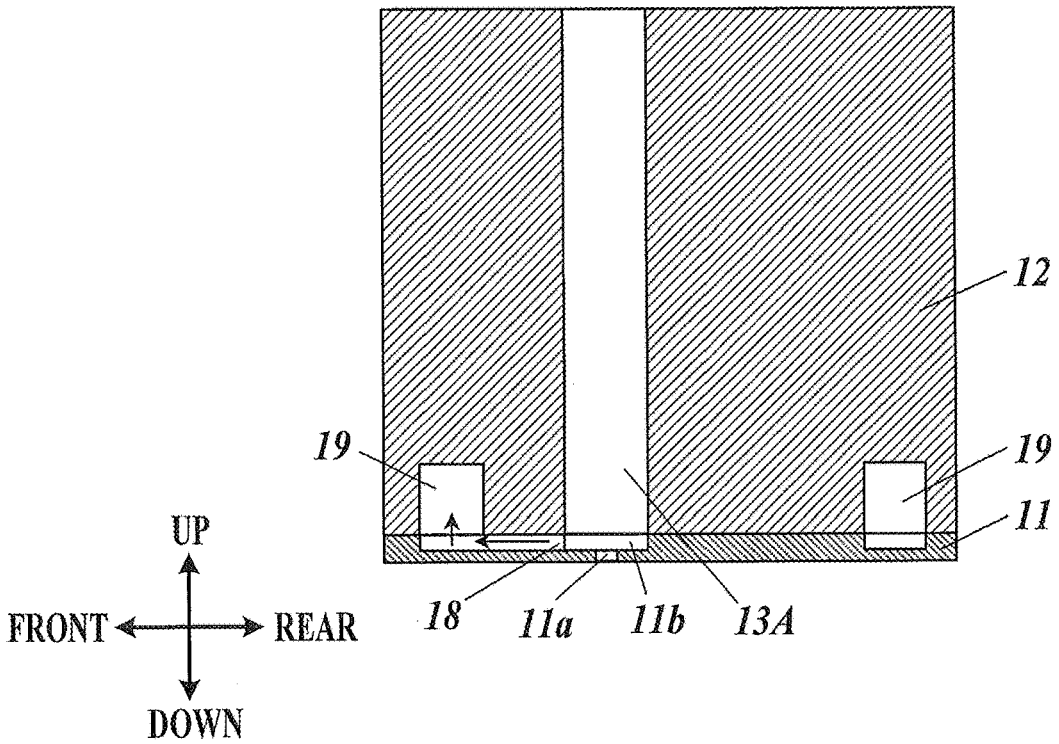
FIG. 8 is a cross-sectional view taken along the line VIII-VIII in FIG. 7.
Figure 13:
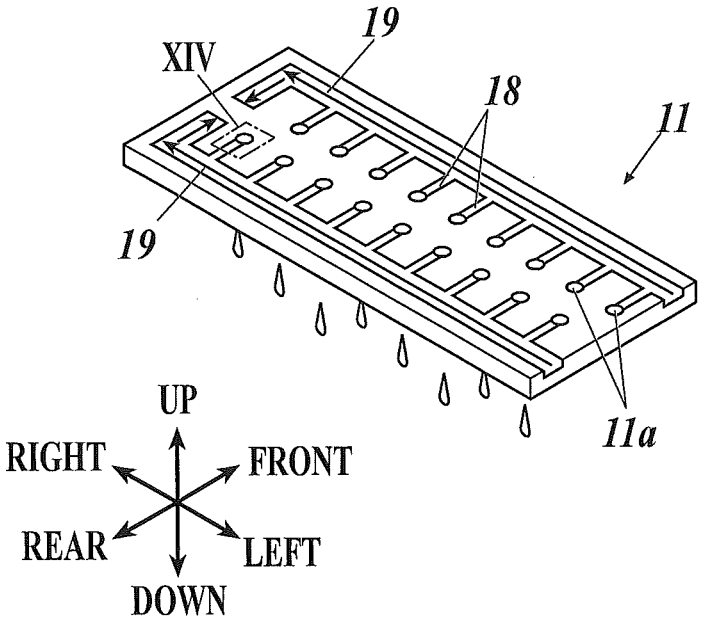
FIG. 13 is a perspective view of a nozzle layer of the head chip.

The individual communication flow paths 18 are disposed in the part facing the pressure chamber layer 12 of the nozzle layer 11, which extend in the front-rear direction from the nozzles 11*a* to the common communication flow paths 19 so as to communicate the pressure chambers 13A with the common communication flow paths 19 (see FIG. 8, FIG. 13 and the like).

Figure 9:
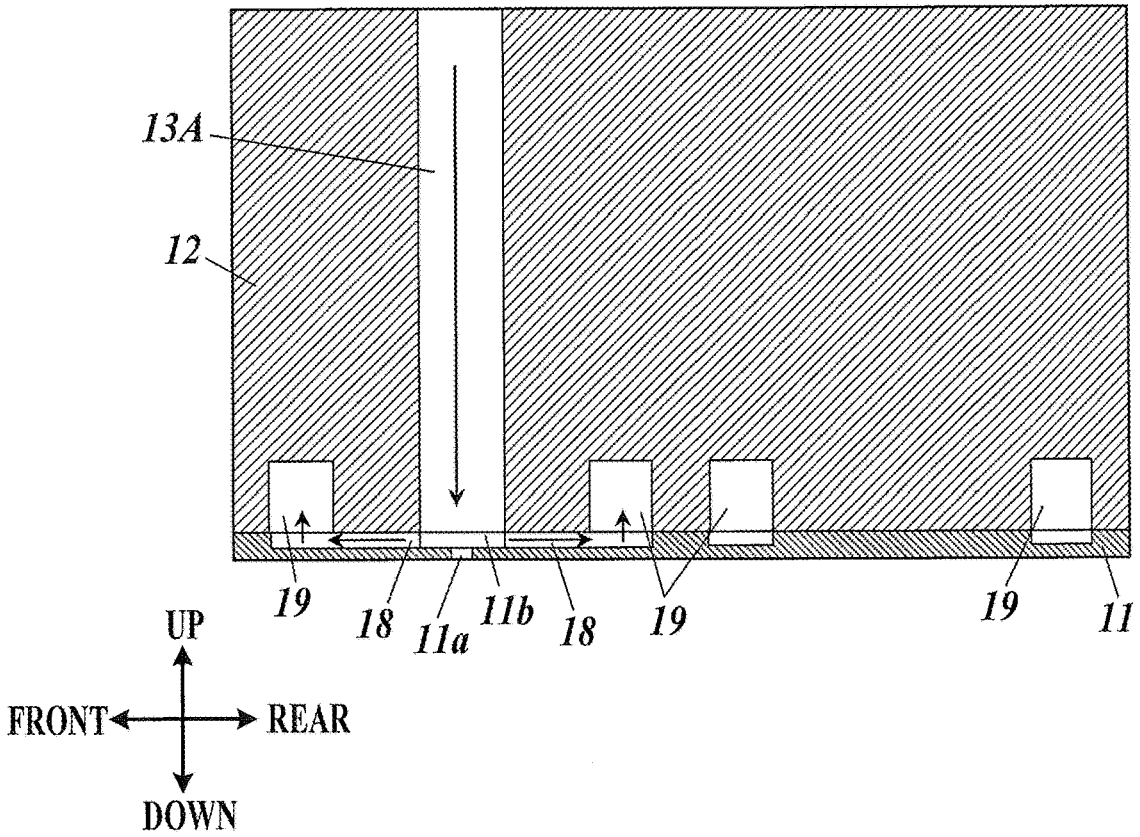
FIG. 9 is a cross-sectional view of a variation of FIG. 8.

In the embodiment, one common communication flow path 19 is provided with respect to each of the nozzle lines, and the individual communication flow paths 18 are disposed only from each nozzle 11*a* to a proximate common communication flow path 19 (FIG. 8 and FIG. 13). However, the configuration is not limited thereto. For example, in a variation as illustrated in FIG. 9, parallel common communication flow paths 19 that are adjacent in the front-rear direction may be provided at both sides in the front-rear direction of the pressure chambers 13A, and individual communication flow paths 18, 18 may be provided toward the common communication flow paths 19, 19 at both sides. This configuration allows further increasing the amount of ink circulated and thereby discharging bubbles and the like more effectively.

In the embodiment, the individual communication flow paths 18 are formed only in the nozzle layer 11. However, it is not necessary to form them exclusively in the nozzle layer 11 as long as they can communicate the pressure chambers 13A with the common communication flow paths 19. The individual communication flow paths 18 may also be formed in the pressure chamber layer 12 or across the nozzle layer 11 and the pressure chamber layer 12.

When the individual communication flow paths 18 are disposed in the nozzle layer 11, it is preferred to form the common communication flow paths 19 across the nozzle layer 11 as illustrated in FIG. 13. This can facilitate the flow of the ink from the individual communication flow paths 18 to the common communication flow paths 19 in the pressure chamber layer 12.

Figure 7:
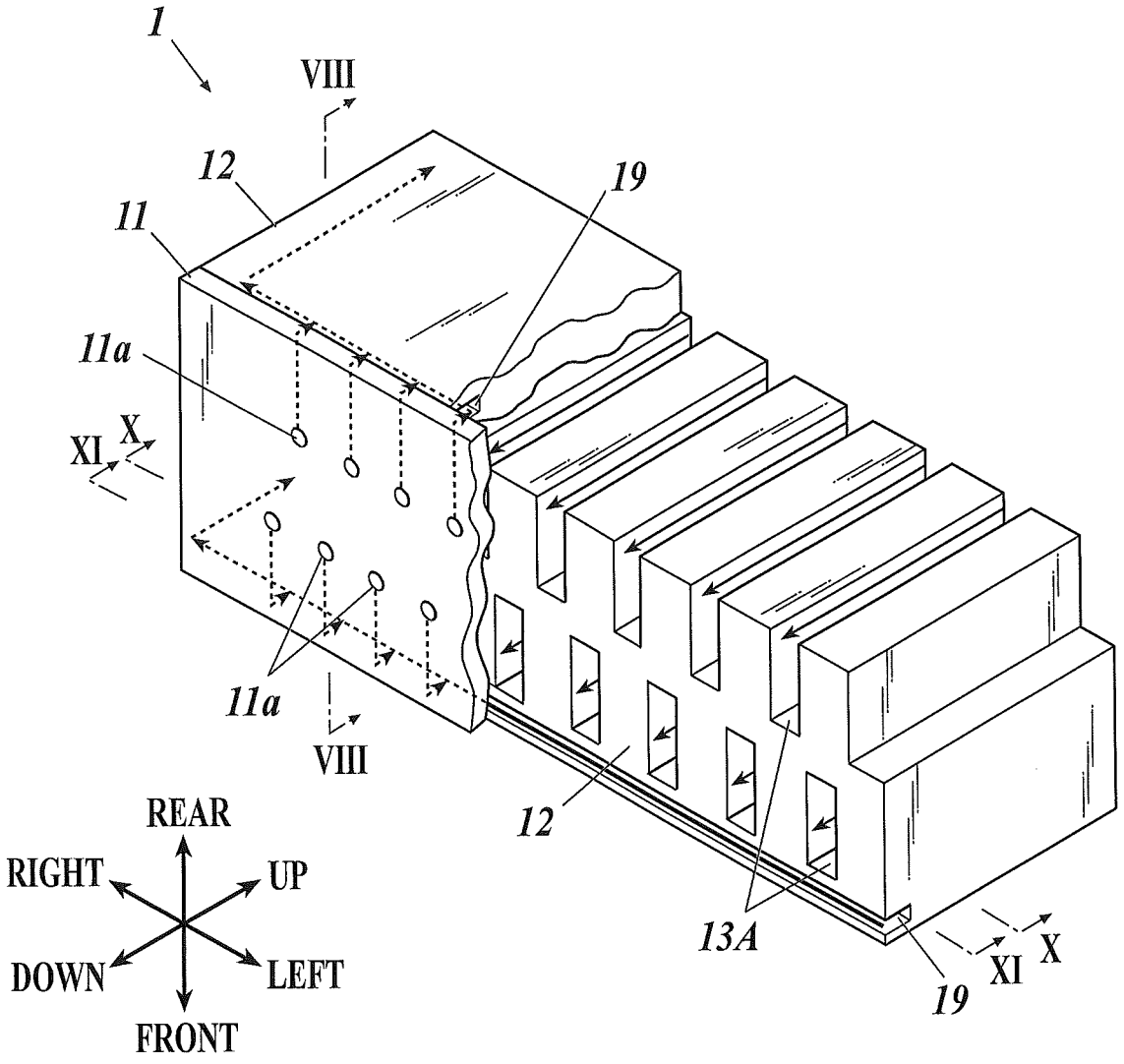
FIG. 7 is a perspective view from below illustrating ink flow in the head chip.

FIG. 11 illustrates a cross section of the head chip 1 taken in the up-down direction through a common communication flow path 19 (taken along the line XI-XI in FIG. 7). A sealing member 12*c* is disposed at an end in the longitudinal direction (right-left direction) of the common communication flow path 19 to close the end. This configuration allows producing the common communication flow paths 19 in the pressure chamber layer 12 such that the common communication flow paths 19 penetrate in the right-left direction (longitudinal direction of the common communication flow paths 19) through the side walls. That is, the common communication flow paths 19 can be produced by a method having high production efficiency.

Figure 12:
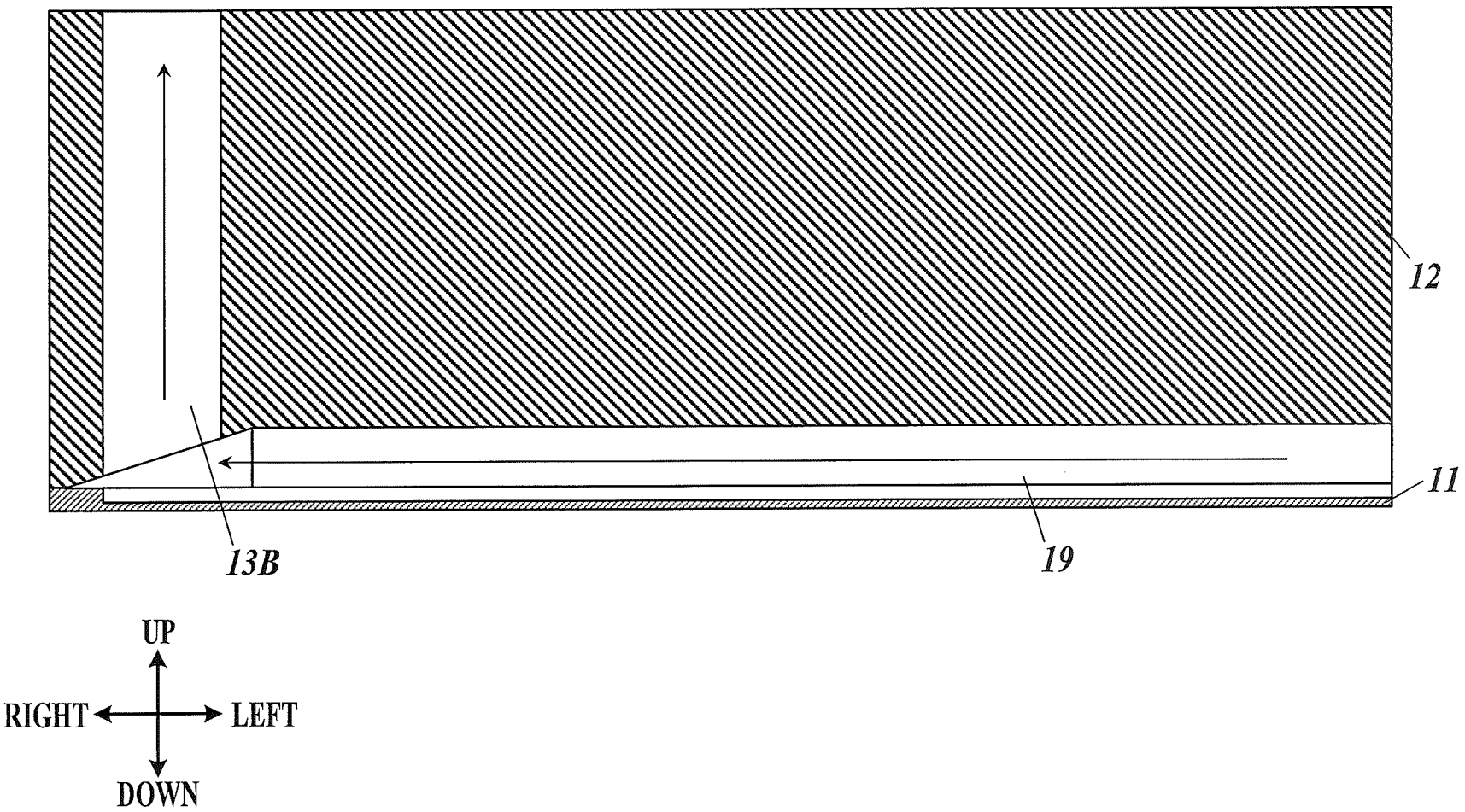
FIG. 12 is a cross-sectional view of a variation of FIG. 11.

The configuration for sealing the common communication flow paths 19 may be changed to any suitable configuration that can seal the common communication flow paths 19 and prevent a leakage of the ink. For example, the width in the up-down direction (ink jetting direction) may be narrowed toward the side walls in the right-left direction of the head chip 1 so that the upper face and the lower face come together to seal the common communication flow paths 19 (FIG. 12). This configuration allows sealing the common communication flow paths 19 only by joining the nozzle layer 11 to the pressure chamber layer 12.

While the left end portion is not shown in FIG. 11 and FIG. 12, it is preferred that the side wall of the common communication flow paths 19 are sealed similarly as in the right end portion.

Figure 14:
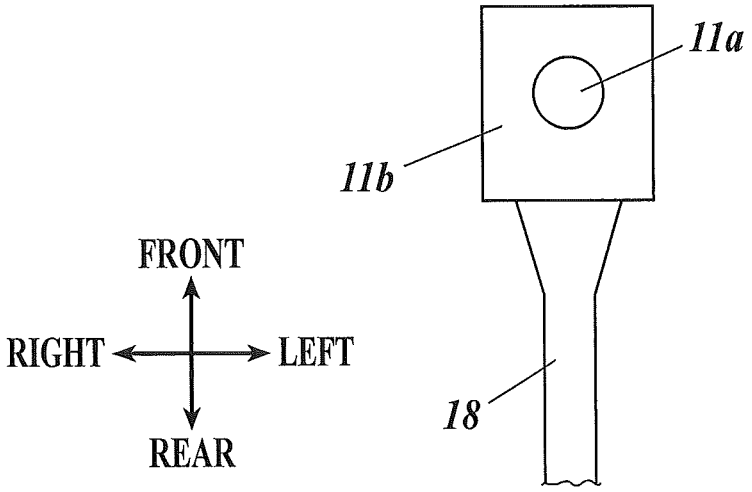
FIG. 14 is an enlarged plan view of the part around the upstream end of an individual communication flow path on an upper surface of the nozzle layer, which is the part XIV indicated by the dashed line in FIG. 13.

FIG. 14 is an enlarged plan view of the part (indicated by the dashed line XIV in FIG. 13) around the upstream end of an individual communication flow path 18 in the upper surface of the nozzle layer 11. As illustrated in FIG. 8 and FIG. 14, rectangular recesses 11*b* are formed at upper parts of the nozzles 11*a* in the nozzle layer 11, and the nozzles 11*a* are pierced in the recesses 11*b*.

As illustrated in FIG. 14, upstream ends of the individual communication flow paths 18 are formed in a tapered shape so that the width becomes greater toward the recesses 11*b*(upstream). This shape is less likely to trap bubbles and makes it easier to discharge bubbles around the nozzles 11*a*.

Figure 15:
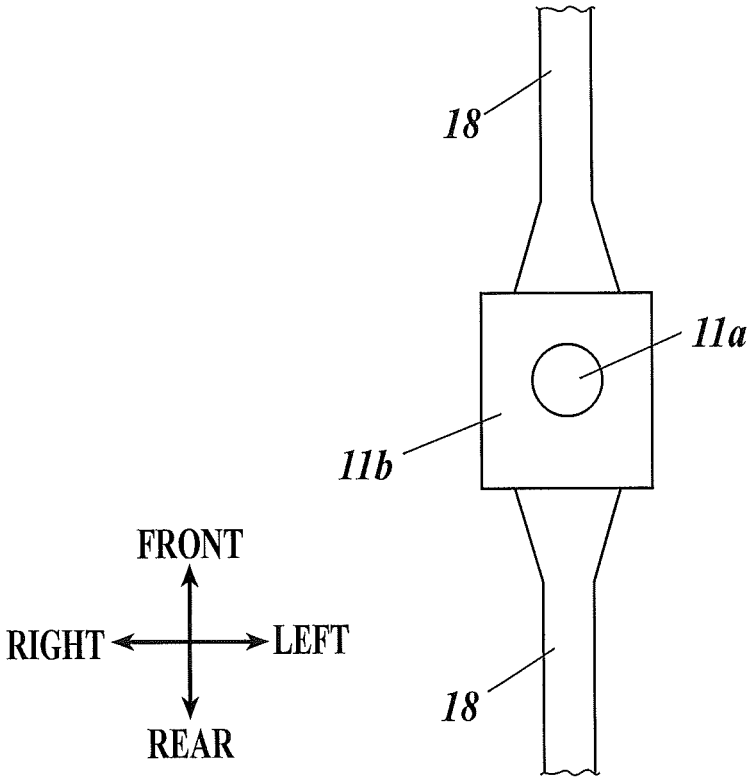
FIG. 15 is a plan view of a variation of FIG. 14.

FIG. 15 is an enlarged plan view of the part around the upstream end of an individual communication flow path 18 of the head chip 1 according to the variation as illustrated in FIG. 9. In the variation, the individual communication flow paths 18, 18 are disposed from recesses 11*b* in the nozzle layer 11 toward the corresponding common communication flow paths 19, 19 that are disposed in front of and behind the recesses 11*b*.

For example, the nozzle layer 11 as described above can be produced by forming the nozzles 11*a*, the recesses 11*b* and the common communication flow paths 18 at once on a polyimide plate by laser machining or on a silicon plate by etching. The material of the nozzle layer 11 may be resin or metal that can be formed by etching.

Figure 5A:
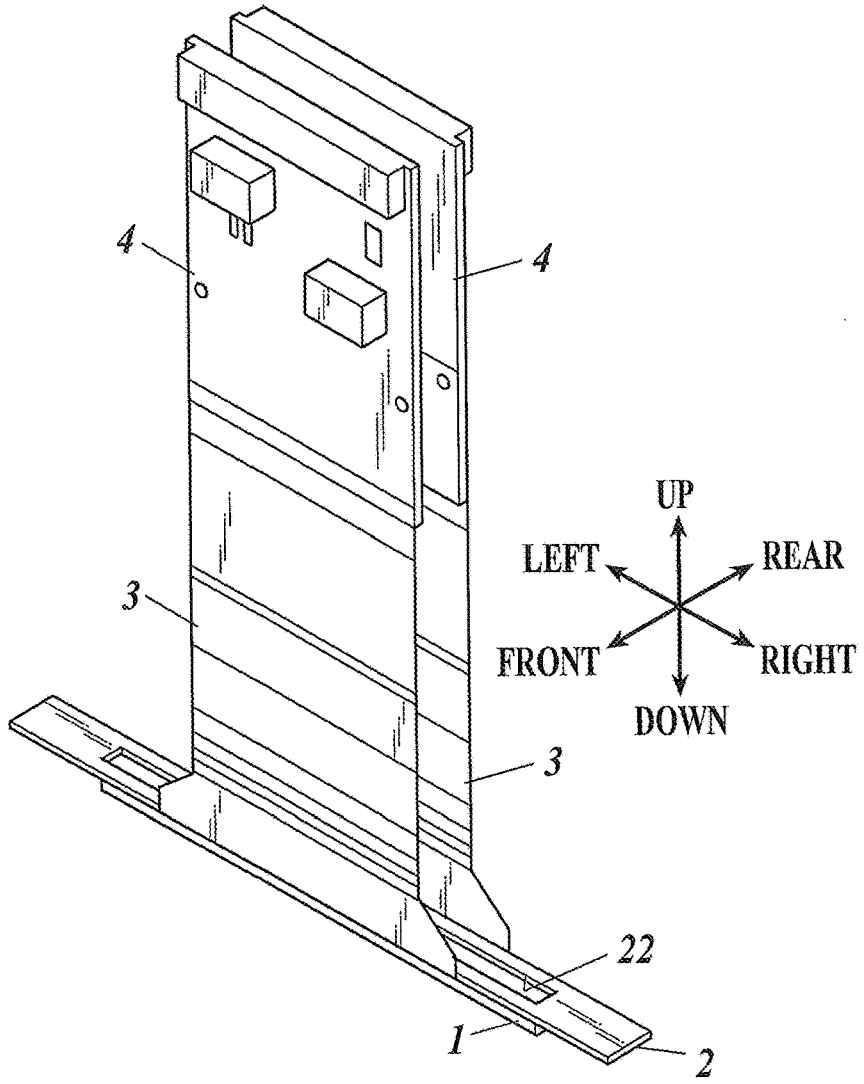
FIG. 5A is a perspective view from above of a head chip, a wiring board, flexible boards and driver circuit boards.
Figure 5B:
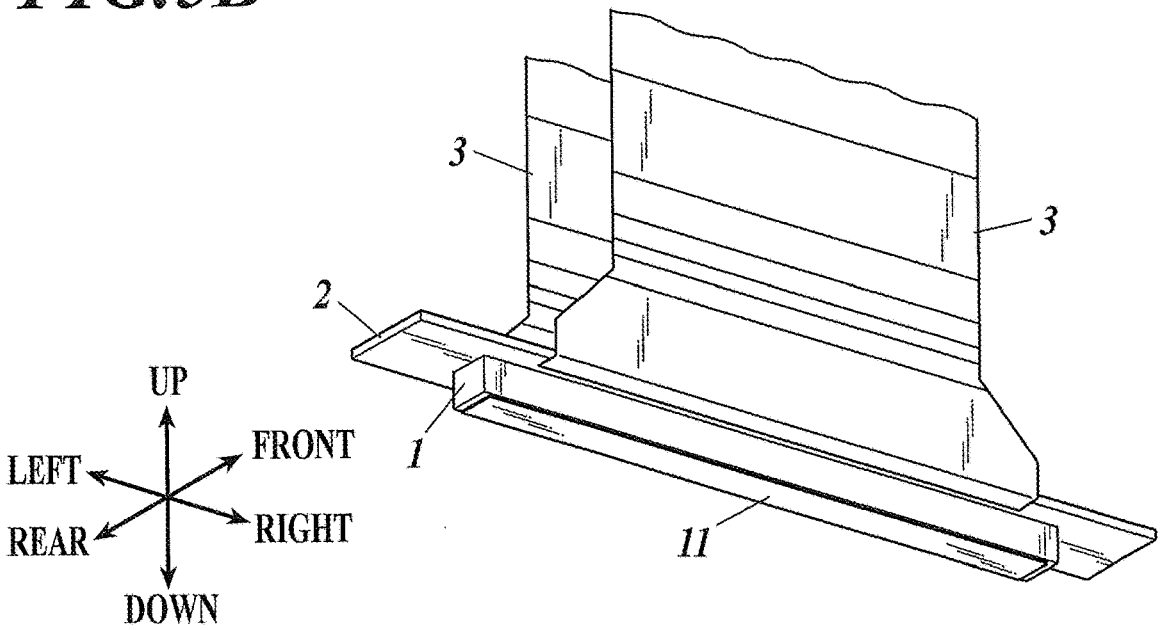
FIG. 5B is a perspective view from below of the head chip, the wiring board, the flexible boards and the driver circuit board.

On the upper face of the head chip 1, the wiring board 2 is disposed as illustrated in FIG. 5A and FIG. 5B. The two flexible board 3, 3, which are connected to the driver circuit boards 4, 4, are disposed at both ends in the right-left direction of the wiring board 2.

The wiring board 2 is formed in an approximately rectangular shape that is long in the right-left direction and has an opening 22 approximately at the center. The width of the wiring board 2 is greater than that of the head chip 1 in both right-left direction and front-rear direction.

The opening 22 is formed in an approximately rectangular shape that is long in the right-left direction so that when the head chip 1 is attached to the wiring board 2, the inlets of the pressure chambers 13A and the outlets of the discharge flow paths 13B of the head chip 1 are exposed upward.

At the edges in the front-rear direction of the opening 22, a predetermined number of electrode parts 21 are disposed, which are connected to electrodes (not shown) on the upper face of the head chip 1 extended from the driver electrodes 14 of the head chip 1 (FIG. 6).

As illustrated in FIG. 4, FIG. 5A, FIG. 5B and the like, the flexible boards 3 are disposed at the ends in the front-rear direction of the wiring board 2.

As illustrated in FIG. 6, the flexible board 3 includes wirings 31, . . . that electrically connect the driver circuit boards 4 to the electrode parts 21 of the wiring board 2. Accordingly, signals from the driver circuit boards 4 are applied to the driver electrodes 14 in the pressure chambers 13A of the head chip 1 via the wirings 31 and the electrode parts 21.

As illustrated in FIG. 4, a lower end of the manifold 5 is fixedly attached to an outer edge of the wiring board 2 by bonding. That is, the manifold 5 is disposed at the inlets (upper side) of the pressure chambers 13A of the head chip 1 and coupled the head chip 1 via the wiring board 2.

Figure 16A:
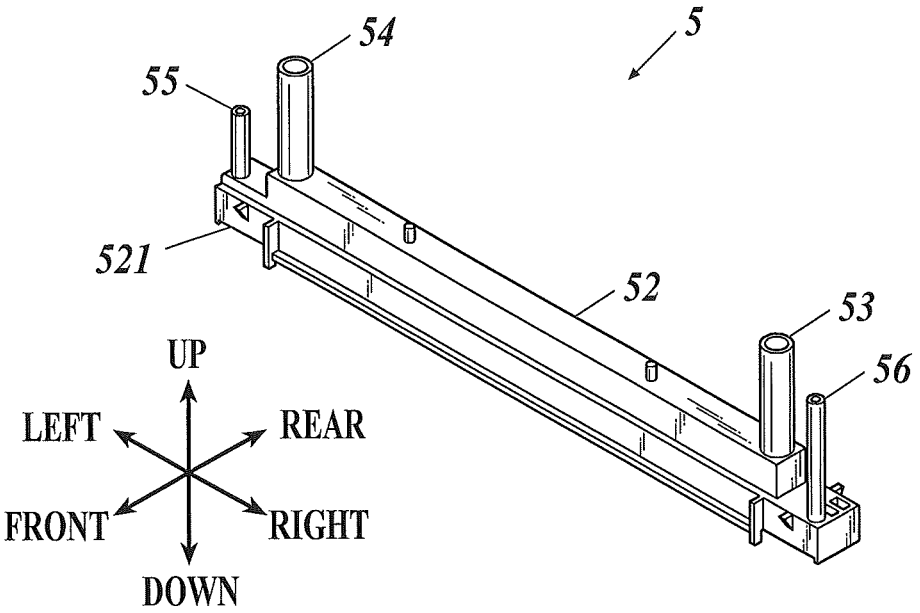
FIG. 16A is a perspective view from above of a manifold.
Figure 16B:
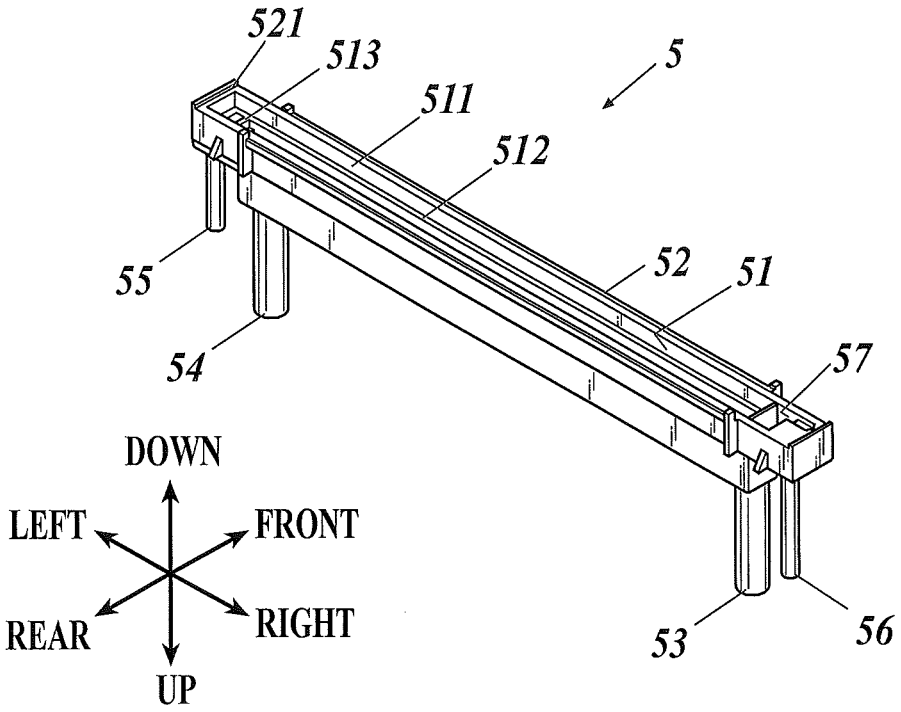
FIG. 16B is a perspective view from below of the manifold.

The manifold 5, which is constituted by a molded resin member, is disposed on the pressure chambers 13A of the head chip 1 to store the ink that is to be introduced to the pressure chambers 13A. Specifically, as illustrated in FIG. 3B, FIG. 16A, FIG. 16B and the like, the manifold 5 is long in the right-left direction. The manifold 5 includes a hollow main body 52 that forms an ink reservoir 51 and first to fourth ink ports 53 to 56 that form ink flow paths.

The main body 52 is formed in a cup shape that is open downward. At the edge of the lower end opening, a wiring board mount 521 is disposed on which the wiring board 2 is fixedly attached by bonding. The wiring board 2 with the head chip 1 is attached to the wiring board mount 521 so as to close the lower end opening. The ink reservoir 51 is thus formed.

The first ink port 53 is communicated to the upper right end of the ink reservoir 51. Further, the second ink port 54 is communicated to the upper left end of the ink reservoir 51, and the third ink port 55 is communicated to the ink reservoir 51 at the further left and lower part relative to the part at which the second ink port 54 is communicated. A discharge room 57 is defined at a right lower end of the ink reservoir 51, which is communicated to the discharge flow paths 13B of the head chip 1. The fourth ink port 56 is communicated to the discharge room 57.

As illustrated in FIG. 3B, a filter F for removing foreign matters in the ink is disposed inside the main body 52 at a slightly lower part from the center in the up-down direction of the ink reservoir 51.

As illustrated in FIG. 3B and FIG. 8B, the ink reservoir 51 includes an inner side wall 511 that stands upward from the lower end of the main body 52 in the up-down direction and has approximately uniform height. The ink reservoir 51 extends a predetermined length inward from the upper end of the inner side wall 511 approximately in the front-back direction and the right-left direction so that a filter edge attaching part 512 is formed which is in contact with an outer edge of an approximately rectangular filter F.

At the left end of the filter edge attaching part 512 and between the second ink port 54 and the third ink port 55, an end filter attaching part 513 is disposed across the front face and the rear face of the inner side wall 511, which is in contact with the part of the filter F that is slightly inside from the left end. The end filter attaching part 513 has approximately the same height as the filter edge attaching part 512.

The filter F is fixedly attached to the end filter attaching part 513 and the filter edge attaching part 512 by bonding.

The filter F disposed in the ink reservoir 51 partitions the ink reservoir 51 into a first room 51*a* that is communicated to the first ink port 53 and the second ink port 54, and a second room 51*b* that is communicated to the pressure chambers 13A of the head chip 1. The second room 51*b* is communicated with the third ink port 55 via the filter F.

The first ink port 53 is provided, for example, to introduce ink to the ink reservoir 51. The first ink port 53 is formed in a cylindrical shape that extends in the up-down direction, and the outer diameter thereof is approximately uniform in the up-down direction. The first ink port 53 is inserted into a first insertion hole 66 (described below) of the case 6 when the manifold 5 is attached to the case 6. The outer diameter of the first ink port 53 is approximately equal to or slightly less than the inner diameter of the first insertion hole 66.

On the tip of the first ink port 53, a first joint 81*a* is fitted. That is, when the manifold 5 is attached to the case 6, the tip of the first ink port 53 is inserted into the first insertion hole 66 to protrude from the upper face of the case 6, and the first joint 81*a* is fitted on the protruded tip in a slidable manner in the up-down direction. The first joint 81*a* is constituted by a hose barb (joint member), and an ink supplying pipe (not shown) is connected to the upper end thereof. Specifically, the first joint 81*a* is formed in a cylindrical shape that extends in the up-down direction. An ink pipe connector 811 is formed at the upper end, and a tip insert 812 is formed below the ink pipe connector 811. In the tip insert 812, the tip of the first ink port 53 is inserted.

The second ink port 54 is provided, for example, to remove bubbles in the first room 51*a*. The second ink port 54 is formed in the approximately the same shape as the first ink port 53.

That is, the second ink port 54 is formed in a cylindrical shape that extends in the up-down direction, and the outer diameter thereof is approximately uniform in the up-down direction. The second ink port 54 is inserted into a second insertion hole 64 (described below) of the case 6 when the manifold 5 is attached to the case 6. The outer diameter of the second ink port 54 is approximately equal to or slightly less than the inner diameter of the second insertion hole 64.

On the tip of the second ink port 54, a second joint 81*b* is fitted. That is, when the manifold 5 is attached to the case 6, the tip of the second ink port 54 is inserted into the second insertion hole 64 to protrude from the upper face of the case 6, and the second joint 81*b* is fitted on the protruded tip in a slidable manner in the up-down direction. The second joint 81*b* includes a tip insert 812 at a lower part thereof, in which the tip of the second ink port 54 is inserted in a slidable manner in the up-down direction. The second joint 81*b* has approximately the same configuration as the first joint 81*a* that is fitted on the first ink port 53, and the detailed description thereof is omitted.

The third ink port 55 is provided, for example, to remove bubbles in the second room 51*b*. The third ink port 55 is formed in a cylindrical shape that extends in the up-down direction, and the outer diameter thereof is approximately uniform in the up-down direction. The third ink port 55 is inserted into a third insertion hole 65 (described below) of the case 6 when the manifold 5 is attached to the case 6. The outer diameter of the third ink port 55 is approximately equal to or slightly less than the inner diameter of the third insertion hole 65.

On the tip of the third ink port 55, a third joint 82 is fitted (see FIG. 3A and the like). That is, when the manifold 5 is attached to the case 6, the tip of the third ink port 55 is inserted into the third insertion hole 65 to protrude from the upper face of the case 6, and the third joint 82 is fitted on the protruded tip in a slidable manner in the up-down direction. The third joint 82 is smaller than the first joint 81*a* or the second joint 81*b* so that it can be fitted on the tip of the third ink port 55. The third joint 82 has approximately the same configuration as the first joint 81*a* and the second joint 81*b*, and the detailed description thereof is omitted.

The fourth ink port 56 is provided to discharge bubbles in the pressure chambers 13A in the head chip 1 out of the ink jet head 100 through the individual communication flow paths 18, the common communication flow paths 19 and the discharge flow paths 13B. The fourth ink port 56 is formed in a cylindrical shape that extends in the up-down direction, and the outer diameter thereof is approximately uniform in the up-down direction. The fourth ink port 56 is inserted into a discharge insertion hole 67 (described below) of the case 6 when the manifold 5 is attached to the case 6. The outer diameter of the fourth ink port 56 is approximately equal to or slightly less than the inner diameter of the discharge insertion hole 67.

Next, the case 6 will be described referring to FIG. 17A and FIG. 17B.

The case 6 is constituted by an aluminum member molded by a diecast method, which is long in the right-left direction. The case 6 is formed to be able to house the manifold 5 on which the head chip 1, the wiring board 2 and the flexible boards 3 are attached, and the bottom face of the case 6 is open.

Specifically, an approximately rectangular lower opening 61 that is long in the right-left direction is formed at the lower end of the case 6. The manifold 5 with the head chip 1, the wiring board 2 and the flexible boards 3 can be inserted into the case 6 from below through the lower opening 61 and placed therein.

At the edge of the lower opening 61, a cap receiver plate attaching part 62 is provided to which a cap receiver plate 7 (see FIG. 4) is fixedly attached.

The cap receiver plate 7 has an approximately rectangular outer shape that is long in the right-left direction corresponding to the shape of the cap receiver plate attaching part 62 as illustrated in FIG. 4. Approximately at a center thereof, a nozzle opening 71 that is long in the right-left direction is formed to expose the nozzle layer 11.

After the manifold 5 with the head chip 1, the wiring board 2 and the flexible boards 3 is disposed in the case 6, the cap receiver plate 7 is attached to the cap receiver plate attaching part 62 such that the nozzle layer 11 is exposed through the nozzle opening 71. The lower opening 61 of the case 6 is thus closed.

Figure 17A:
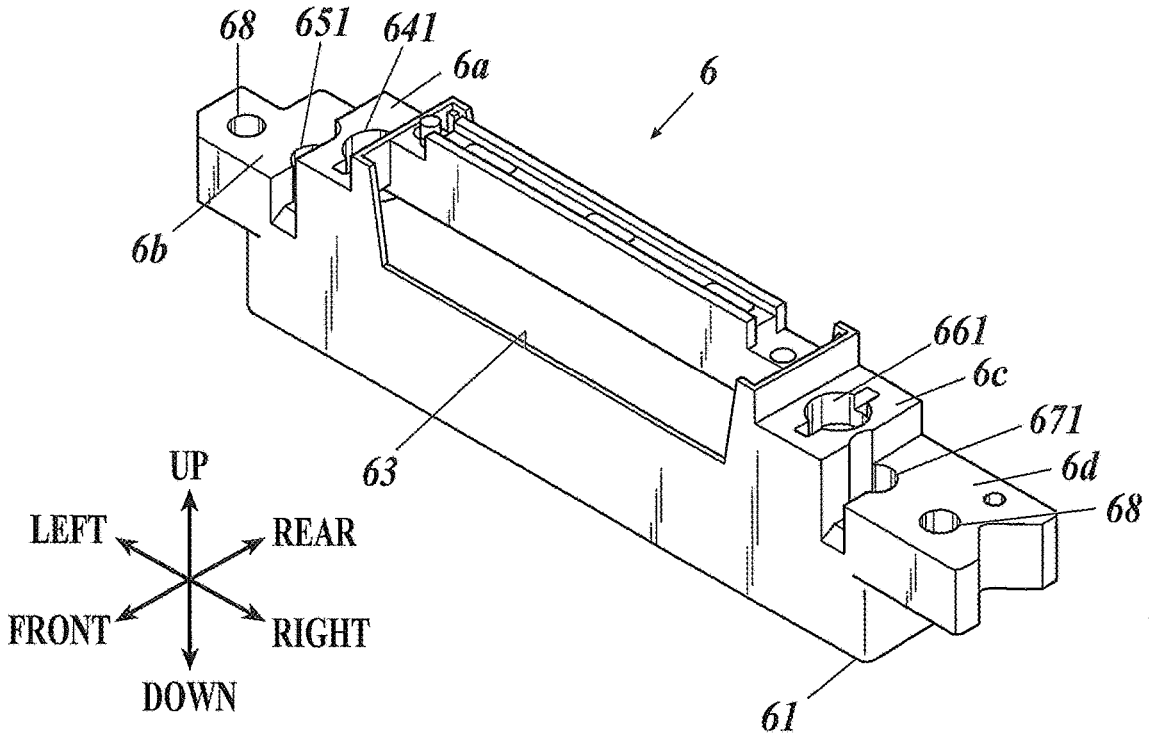
FIG. 17A is a perspective view from above of a case.
Figure 17B:
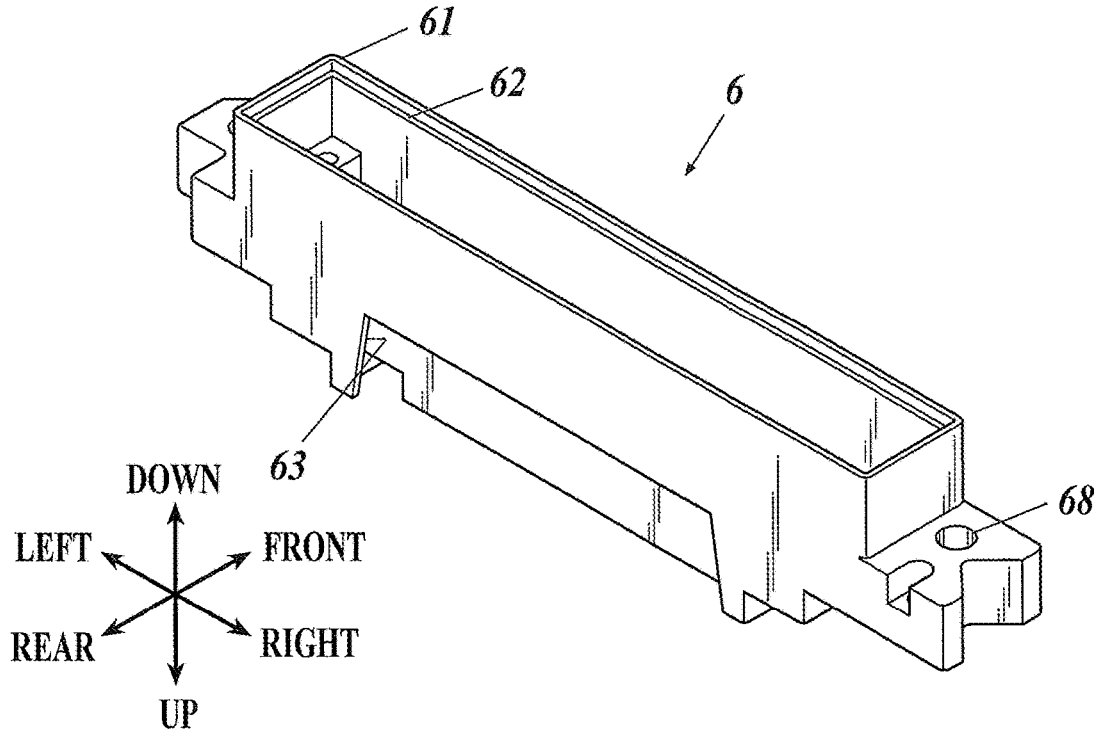
FIG. 17B is a perspective view form below of the case.

As illustrated in FIG. 4, FIG. 17A, FIG. 17B and the like, two board insert openings 63 are formed approximately at the center in the right-left direction of the case 6, in which the two driver circuit boards 4, 4 and the flexible boards 3, 3 connected to the manifold 5 are inserted.

The board insert openings 63, 63 are closed when the cover member 9 (see FIG. 3A) is attached to the case 6.

To the left of the two board insert openings 63, 63 of the case 6, the second insertion hole 64 is formed in which the tip of the second ink port 54 of the manifold 5 is inserted. Slightly to the left of the second insertion hole 64 and at a height lower than the second insertion hole 64, a third insertion hole 65 is formed in which the tip of the third ink port 55 of the manifold 5 is inserted (see FIG. 3B).

The second insertion hole 64 is formed in a left upper recess 641 that is recessed to a predetermined depth from a left first upper face 6*a* of the case 6. The second insertion hole 64 penetrates the bottom of the left upper recess 641 in the up-down direction. The size of the second insertion hole 64 is approximately equal to or slightly greater than the outer diameter of the second ink port 54. The outer edge of the second insertion hole 64 is approximately parallel to the right-left direction and the front-rear direction.

The third insertion hole 65 is disposed in a left lower recess 651 that is recessed to a predetermined depth from a left second upper face 6*b* that is lower than the left first upper face 6*a*. The third insertion hole 65 penetrates the bottom face of the left lower recess 651 in the up-down direction. The size of the third insertion hole 65 is approximately equal to or slightly greater than the outer diameter of the third ink port 55. The outer edge of the third insertion hole 65 is approximately parallel to the right-left direction and the front-rear direction.

To the right of the two board insert openings 63, 63 of the case 6, the first insertion hole 66 is formed at approximately the same height as the second insertion hole 64, in which the tip of the first ink port 53 of the manifold 5 is inserted. Slightly to the right of the first insertion hole 66 and at a height lower than the first insertion hole 66, a discharge insertion hole 67 is formed in which the fourth ink port 56 of the manifold 5 is inserted (see FIG. 3B).

The first insertion hole 66 is disposed in a right upper recess 661 that is recessed to a predetermined depth from a right first upper face 6*c* of the case 6. The first insertion hole 66 penetrates the bottom face of the right upper recess 661 in the up-down direction. The size of the first insertion hole 66 is approximately equal to or slightly greater than the outer diameter of the first ink port 53. Further, the outer edge of the first insertion hole 66 is approximately parallel to the right-left direction and the front-rear direction.

The discharge insertion hole 67 is disposed in a right lower recess 671 that is recessed to a predetermined depth from a right second upper face 6*d* that is lower than the right first upper face 6*c*. The discharge insertion hole 67 penetrates the bottom of the right lower recess 671 in the up-down direction. The size of the discharge insertion hole 67 is approximately equal to or slightly greater than the outer diameter of the fourth ink port 56. An outer edge of the discharge insertion hole 67 is approximately parallel to the right-left direction and the front-rear direction.

At an end and to the left of the third insertion hole 65 of the case 6 and at an end and to the right of the discharge insertion hole 67, attach holes 68 are respectively formed for attaching the case 6 to a printer main body.

Ink Circulating Mechanism

The ink jet recording apparatus 200 of the embodiment includes the ink circulating mechanism 8 as an ink circulator. For the ink circulating mechanism 8, any suitable configuration may be selected that can generate a circulation flow from the pressure chamber 13A to the individual communication flow paths 18 to discharge the ink in the pressure chamber 13A out of the head chip through the discharge flow paths 13B. An example configuration will be described in the following.

Figure 18:
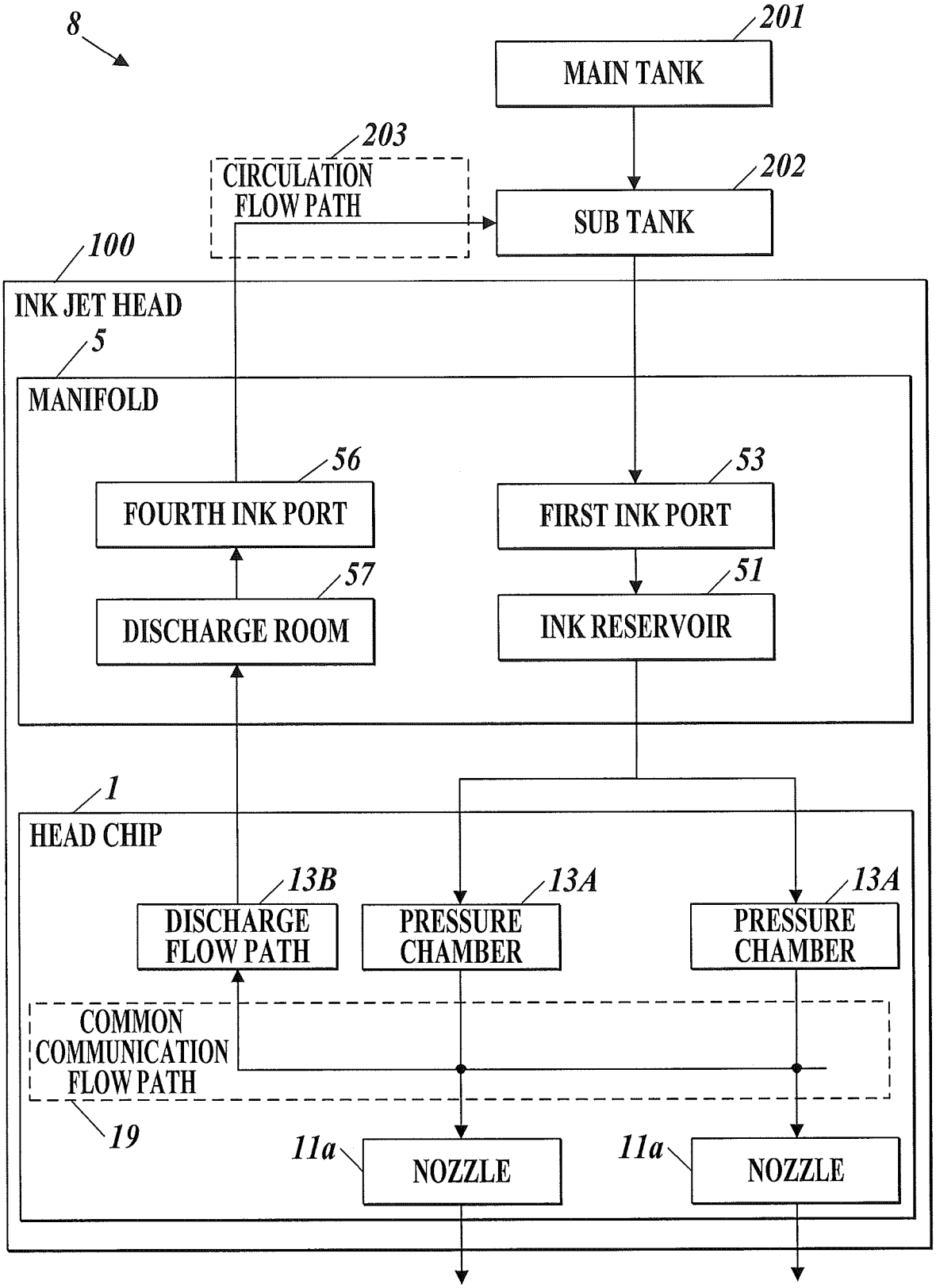
FIG. 18 is a conceptual view illustrating an ink circulating mechanism of the ink jet recording apparatus.

The ink circulating mechanism 8 includes a main tank 201, a sub tank 202, a circulation flow path 203 and the like (FIG. 18). FIG. 18 is a conceptual view illustrating circulation of the ink in the ink jet recording apparatus 200, in which the arrows represent flow direction of the ink.

The main tank 201 is filled with the ink that is to be supplied to the sub tank 202. The main tank 201 is connected to the sub tank 202 by an ink flow path. For example, the ink can be supplied from the main tank 201 to the sub tank 202 by means of pressure that is applied by using a pump (not shown) as a pressure generator.

The sub tank 202 is filled with ink that is to be supplied to the ink jet head 100. The sub tank 202 is connected to the first ink port 53 of the ink jet head 100 by an ink flow path. For example, the ink can be supplied from the sub tank 202 to the ink jet head 100 by means of pressure that is applied by using a pump (not shown) as a pressure generator. The sub tank 202 has a gas-liquid separating function and can separate bubbles from the ink stored therein.

The ink supplied from the sub tank 202 to the ink jet head 100 flows into the pressure chambers 13A through the first ink port 53 and the ink reservoir 51. That is, in the embodiment, the first ink port 53 and the ink reservoir 51 serve as a flow path for supplying the ink from the upstream of the pressure chambers 13A to the pressure chambers 13A. As described above, when a voltage is applied to the driver electrodes 14 of the pressure chambers 13A, the partition wall between adjacent pressure chambers 13A is displaced so that the ink in the pressure chambers 13A is jetted through the nozzles 11*a*.

While being jetted through the nozzles 11*a* as described above, the ink in the pressure chambers 13A also flows into the common communication flow paths 19 via the individual communication flow paths 18 along with bubbles and is thereafter discharged out of the ink jet head 100 through the discharge flow paths 13B, the discharge room 57 and the fourth ink port 56. That is, in the embodiment, the discharge flow paths 13B, the discharge room 57 and the fourth ink port 56 together serve as a flow path for discharging the ink from the common communication flow paths 19 out of the ink jet head 100.

The fourth ink port 56 of the ink jet head 100 is connected to a circulation flow path 203 for supplying the ink discharged from the fourth ink port 56 to the sub tank 202. The ink discharged from the fourth ink port 56 is supplied to the sub tank 202 through the circulation flow path 203 and is thereafter separated from bubbles and reused.

Advantageous Effects of Invention

As described above, the head chip 1 of the ink jet head 100 of the present invention includes:

the nozzle layer 11 with the nozzles 11*a;* the pressure chamber layer 12 with the pressure chambers 13A communicated respectively with the nozzles 11*a;* the individual communication flow paths 18 which are communicated respectively with the pressure chambers 13A and which are capable of discharging ink in the pressure chamber 13A; and the common communication flow paths 19 which are disposed in the part facing the nozzle layer of the pressure chamber layer 12 and which are connected to the individual communication flow paths 18 to join the ink discharged from the individual communication flow paths 18 together.

Since the common communication flow path is disposed in the pressure chamber layer 12, it is possible to secure a large volume for the common communication flow path 19 for discharging ink so that bubbles and the like are effectively discharged. Furthermore, it is possible to reduce the size by disposing partition walls at regular intervals. By providing the common communication flow path 19 having a large volume, it is possible to increase the amount of ink circulated in the head chip 1 so that heat from the head chip 1 is effectively dissipated.

In the ink jet head 100 according to the embodiment, the width in the up-down direction (the ink jetting direction) of the common communication flow path 19 of the head chip 1 is greater than the thickness of the nozzle layer 11. This allows the larger volume of the flow path compared to the case in which the common communication flow path 19 is disposed only in the nozzle layer 11.

In the ink jet head 100 according to the embodiment, the individual communication flow paths 18 are disposed in the part facing the pressure chamber layer 12 of the nozzle layer 11. This allows forming the individual communication flow paths 18 at high precision by etching, etc. on a plate of the nozzle layer 11.

In the ink jet head 100 according to the embodiment, the pressure chamber layer 12 includes the discharge flow paths 13B which are communicated with the common communication flow paths 19 and which are capable of discharging the ink upward (the opposite side from the nozzle layer 11). Since a discharge port of the ink is located in an upper part, it is possible to reduce the size of the ink jet head 100.

In the ink jet head 100 according to the embodiment, the sealing member 12*c* is provided in the common communication flow paths 19 at an end in the longitudinal direction of the head chip 1 (right-left direction). This allows forming the common communication flow paths 19 in the head chip such that the common communication flow paths 19 penetrate the side walls in the longitudinal direction. Therefore, the ink jet head 100 can be produced by a method having high production efficiency.

In the ink jet head 100 according to the embodiment, the width in the ink jetting direction (up-down direction) of the common communication flow paths 19 decreases toward the ends in the longitudinal direction (right-left direction) of the head chip 1 so that the upper face and the lower face come together to seal the common communication flow paths 19. This allows sealing the common communication flow paths only by joining the nozzle layer 11 to the pressure chamber layer 12.

In the ink jet head 100 according to the embodiment, the manifold 5 is disposed above the pressure chambers 13A. Since the ink can be supplied and discharged only in the upper part, it is possible to further reduce the size of the ink jet head 100.

The ink jet head 100 according to the embodiment is suitably applicable to a share-mode ink jet head 100 with pressure chambers 13A partitioned from each other by a partition wall that causes share-mode displacement when a voltage is applied.

The ink jet recording apparatus 200 includes the ink jet head 100 according to the embodiment and the ink circulator for generating a circulation flow from the pressure chambers 13A to the individual communication flow paths 18. With this configuration, the ink jet recording apparatus 200 can discharge bubbles near the pressure chambers 13A and the nozzles 11*a* out of the ink jet head 100 along with the ink.

Others

It should be understood that the above-described embodiment of the present invention is exemplary and not limitative in any way. That is, the scope of the present invention is defined not by the above description but by the claims, and it is intended to encompass all changes within the scope and the meaning of the claims and the equivalent thereof.

For example, a share-mode ink jet head 100 is described as an example of the ink jet head 100. However, the ink jet head 100 is not limited to the share-mode type, and it is only necessary that a means for applying a pressure to the ink in the pressure chambers 13A is provided.

A single-pass ink jet recording apparatus 200 with the line heads is described as the ink jet recording apparatus 200. However, the ink jet recording apparatus 200 may also be a scanning ink jet recording apparatus.

In the embodiment, the head chip 1 has two nozzle lines. However, the number of lines and the arrangement of the nozzles 11*a* may be suitably changed. For example, the head chip 1 may have a single nozzle line, or three or more nozzle lines.

Further, the two discharge flow paths 13B are provided at the right part of the pressure chamber layer 12. However, only a single combined discharge flow path may be provided. Further, another discharge flow path 13B may be disposed at the left side in addition to the right side.

The ink circulating mechanism 8 is described with FIG. 18. However, the configuration may be suitably changed as long as the ink circulating mechanism 8 can generate a circulating flow from the pressure chambers 13A to the individual communication flow paths 18 to discharge the ink in the pressure chambers 13A out of the head chip through the discharge flow paths 13B.

In the head unit 224, pairs of ink jet heads 100 each adjacent in the front-rear direction are arranged in a staggered pattern that staggers in the front-rear direction. However, the arrangement of the ink jet heads 100 may be suitably changed.

FIG. 12 illustrates an example in which the common communication flow paths 19 get narrower toward the ends in the longitudinal direction so that the upper face and the lower face come together. However, the configuration is not limited to the example in FIG. 12 in which the upper face and the lower face are gradually come close to each other. For example, the upper face may be formed in stepwise pattern.

The pressure chambers 13A and the discharge flow paths 13B of the head chip 1 are straight that are open in the top and bottom faces of the head chip. Instead, while they are open in the bottom face of the head chip 1, they may be curved in the upper part and open in a side face of the head chip 1.

INDUSTRIAL APPLICABILITY

The present invention is applicable to ink jet heads and ink jet recording apparatuses.

REFERENCE SIGNS LIST

1 Head chip
5 Manifold
8 Ink circulating mechanism (ink circulator)
11 Nozzle layer
11*a* Nozzle
12 Pressure chamber layer
12*c* Sealing member
13A Pressure chamber
13B Discharge flow path
18 Individual communication flow path
19 Common communication flow path
100 Ink jet head
200 Ink jet recording apparatus

The invention claimed is:

1. An ink jet head, comprising:

a head chip which comprises a nozzle layer with nozzles for jetting ink and a pressure chamber layer with pressure chambers communicated respectively with the nozzles; and a manifold which stores the ink to be supplied to the pressure chambers;

wherein the head chip comprises:

individual communication flow paths which are communicated respectively with the pressure chambers and which are capable of discharging the ink in the pressure chambers; and common communication flow paths which are disposed in a part facing the nozzle layer of the pressure chamber layer and which is connected to the individual communication flow paths to join the ink discharged from the individual communication flow paths together;

wherein the individual communication flow paths and the common communication flow path are configured to draw ink not ejected from the nozzles away from the nozzles and the pressure chambers to remove the ink from the ink jet head, and wherein the individual communication flow paths are disposed in the nozzle layer and a portion of the individual communication flow paths faces the pressure chamber layer;

wherein two common communication flow paths are disposed at opposing sides of the pressure chamber, and the common communication flow paths are connected to the same pressure chamber via two individual communication flow paths, such that each of the common communication flow paths direct a flow of ink away from the same nozzle.

2. The ink jet head according to claim 1, wherein a width in an ink jetting direction of the common communication flow path is greater than a thickness of the nozzle layer.

3. The ink jet head according to claim 1, wherein the pressure chamber layer comprises a discharge flow path which is communicated with the common communication flow path and which is capable of discharging the ink toward an opposite side from the nozzle layer.

4. The ink jet head according to claim 1, wherein a sealing member is provided in the common communication flow path at an end in a longitudinal direction of the head chip.

5. The ink jet head according to claim 1, wherein a width in an ink jetting direction of the common communication flow path decreases toward an end in the longitudinal direction of the head chip so that an upper face and a lower face come together to seal the common communication flow path.

6. The ink jet head according to claim 1, wherein the manifold is disposed above the pressure chambers.

7. The ink jet head according to claim 1, wherein the pressure chambers are partitioned from each other by a partition wall that causes share-mode displacement when a voltage is applied.

8. An ink jet recording apparatus, comprising:

the ink jet head according to claim 1;

an ink circulator for generating a circulation flow from the pressure chambers to the individual communication flow paths.

9. The ink jet head according to claim 1, wherein the common communication flow path is oriented horizontally and directs the ink along the head chip in a lateral direction.

* * * * *